US009533188B2

(12) United States Patent
Carter et al.

(10) Patent No.: US 9,533,188 B2
(45) Date of Patent: Jan. 3, 2017

(54) FUNCTIONAL TRAINING EQUIPMENT WITH MULTIPLE MOVEMENT PLANES USED FOR LOWER BODY EXERCISES

(71) Applicant: Tuffstuff Fitness International, Inc., Chino, CA (US)

(72) Inventors: Kenneth Evans Carter, Claremont, CA (US); Sherman P. Grider, Netarts, OR (US); Pastor Sanchez, Pomona, CA (US)

( * ) Notice: Subject to any disclaimer, the term of this patent is extended or adjusted under 35 U.S.C. 154(b) by 106 days.

(21) Appl. No.: 14/494,977

(22) Filed: Sep. 24, 2014

(65) Prior Publication Data

US 2016/0082315 A1 Mar. 24, 2016

(51) Int. Cl.

| | |
|---|---|
| ***A63B 23/04*** | (2006.01) |
| ***A63B 21/00*** | (2006.01) |
| ***A63B 21/06*** | (2006.01) |

(52) U.S. Cl.

CPC ..... *A63B 23/0494* (2013.01); *A63B 21/00065* (2013.01); *A63B 21/06* (2013.01); *A63B 21/1488* (2013.01)

(58) Field of Classification Search

CPC ..... A63B 23/0405; A63B 23/0411; A63B 21/4043; A63B 21/4047

USPC ..... 482/95, 96

See application file for complete search history.

(56) References Cited

U.S. PATENT DOCUMENTS

| | | | | |
|---|---|---|---|---|
| 5,106,081 | A * | 4/1992 | Webb | A63B 21/155 482/100 |
| 5,334,120 | A | 8/1994 | Rasmussen | |
| 5,352,171 | A | 10/1994 | Lin | |
| 5,580,340 | A * | 12/1996 | Yu | A63B 21/055 482/72 |
| 6,220,993 | B1 * | 4/2001 | Sencil | A63B 21/0615 482/137 |
| 6,264,588 | B1 | 7/2001 | Ellis | |
| 6,287,241 | B1 | 9/2001 | Ellis | |
| 6,605,024 | B2 * | 8/2003 | Stearns | A63B 21/0615 482/136 |
| 6,916,278 | B2 | 7/2005 | Webber | |
| 7,052,444 | B2 * | 5/2006 | Webber | A63B 21/068 482/100 |
| 7,220,221 | B2 * | 5/2007 | Mosimann | A63B 23/0222 482/100 |
| 7,594,880 | B2 | 9/2009 | Webber et al. | |
| 7,654,938 | B2 | 2/2010 | Webber et al. | |
| 7,670,269 | B2 | 3/2010 | Webber et al. | |

(Continued)

*Primary Examiner* — Joshua Kennedy

(74) *Attorney, Agent, or Firm* — TD Foster; Bruce Hare; Thomas D. Foster

(57) ABSTRACT

A leg press machine is described. The leg press machine includes: a cable resistance element adapted to allow for a resistance path that is at least partly defined by a user; a user support adapted to move along a movement path as a leg press is performed; a load including a set of plates that may be selectively coupled to the cable resistance element; a rail; a carriage movably coupled to the rail, wherein the movement path is at least partly defined by movement of the carriage along the rail, and the user support is movably coupled to the carriage at a first pivot axis; a column; and a connecting element movably coupled to the column, wherein the movement path is at least partly defined by movement of the connecting element along the column, and the user support is movably coupled to the connecting element.

4 Claims, 54 Drawing Sheets

(56) References Cited

U.S. PATENT DOCUMENTS

| | | | | |
|---|---|---|---|---|
| 7,794,372 | B1 * | 9/2010 | Webber | A63B 23/0405 482/100 |
| 7,878,953 | B2 * | 2/2011 | Webber | A63B 21/0628 482/71 |
| 7,963,890 | B2 | 6/2011 | Webber et al. | |
| 7,976,440 | B2 | 7/2011 | Webber et al. | |
| 7,988,603 | B2 | 8/2011 | Webber et al. | |
| 8,002,679 | B2 | 8/2011 | Webber et al. | |
| 8,317,665 | B2 | 11/2012 | Webber et al. | |
| 8,425,384 | B2 | 4/2013 | Garner | |
| 2013/0324374 | A1 | 12/2013 | Ellis | |
| 2013/0331238 | A1 | 12/2013 | Ellis | |
| 2014/0121070 | A1 | 5/2014 | Ellis | |

* cited by examiner

FUNCTIONAL TRAINING EQUIPMENT WITH MULTIPLE MOVEMENT PLANES USED FOR LOWER BODY EXERCISES

BACKGROUND OF THE INVENTION

Functional training is a classification of exercise which involves training the body for activities performed in daily life. Functional Training leads to better joint mobility, joint stability, and more efficient motor patterns which includes strength and balance. The origins of functional training are derived from physical or occupational rehabilitation using exercises that mimic normal activities. The use of traditional strength machines delivers single plane or fixed pattern motion, which targets only a specific muscle and does not necessarily bear any relationship to the movements people make in their regular activities.

Many existing solutions subject a user to a mode of interaction and level of stress on the body that can be counterproductive or cause unnecessary injury. In addition, existing solutions may require body positions that are unnatural and/or cause a deviation from a biomechanically correct exercise position through a range of movement.

Thus there is a need for equipment that provides a natural, progressive motion that allows a user to maintain a biomechanically correct position across a circuit of exercise stations that allows a user to define a specific course of functional exercise.

BRIEF SUMMARY OF THE INVENTION

Some embodiments provide a way for a user to perform functional training Some embodiments may provide a set of exercise machines that may be used to form a training circuit for a user. Each exercise machine may include a movement path associated with an exercise. The movement path may include a resistance path and a user movement path.

As a user proceeds through an exercise movement, the body position of the user may be automatically adjusted such that the user remains in a biomechanically correct position throughout the exercise. The body position may be maintained using a natural arc movement in some embodiments.

In addition, the body position of the user (and/or the body weight of the user) may provide an assist at various places along the resistance path such that a user is able to complete a full movement. This approach may increase gains in strength and flexibility. Furthermore, the natural, functional movement of some embodiments may engage additional muscle groups through the arc movement.

The exercise machines of some embodiments may include cable connections to resistance elements. Such an arrangement may allow each user to at least partially define a resistance path. This approach may improve user comfort and allow for a full range of motion as well as engaging additional muscle groups as compared to a fixed resistance path.

A first exemplary embodiment provides a leg press machine adapted to perform functional training. The leg press machine includes: a cable resistance element adapted to allow for a resistance path that is at least partly defined by a user; a user support adapted to move along a movement path as a leg press is performed; and a load including a set of plates that may be selectively coupled to the cable resistance element.

A second exemplary embodiment provides a leg curl machine adapted to perform functional training. The leg curl machine includes: a cable resistance element adapted to allow for a resistance path that is at least partly defined by a user; a user support adapted to move along a movement path as a leg curl is performed; and a load including a set of plates that may be selectively coupled to the cable resistance element.

A third exemplary embodiment provides a leg extension machine adapted to perform functional training. The leg extension machine includes: a cable resistance element adapted to allow for a resistance path that is at least partly defined by a user; a user support adapted to move along a movement path as a leg extension is performed; and a load including a set of plates that may be selectively coupled to the cable resistance element.

The preceding Brief Summary is intended to serve as a brief introduction to various features of some exemplary embodiments of the invention. Other embodiments may be implemented in other specific forms without departing from the spirit of the invention.

BRIEF DESCRIPTION OF THE SEVERAL VIEWS OF THE DRAWINGS

The novel features of the invention are set forth in the appended claims. However, for purpose of explanation, several embodiments of the invention are illustrated in the following drawings.

DETAILED DESCRIPTION OF THE INVENTION

Figure 1:
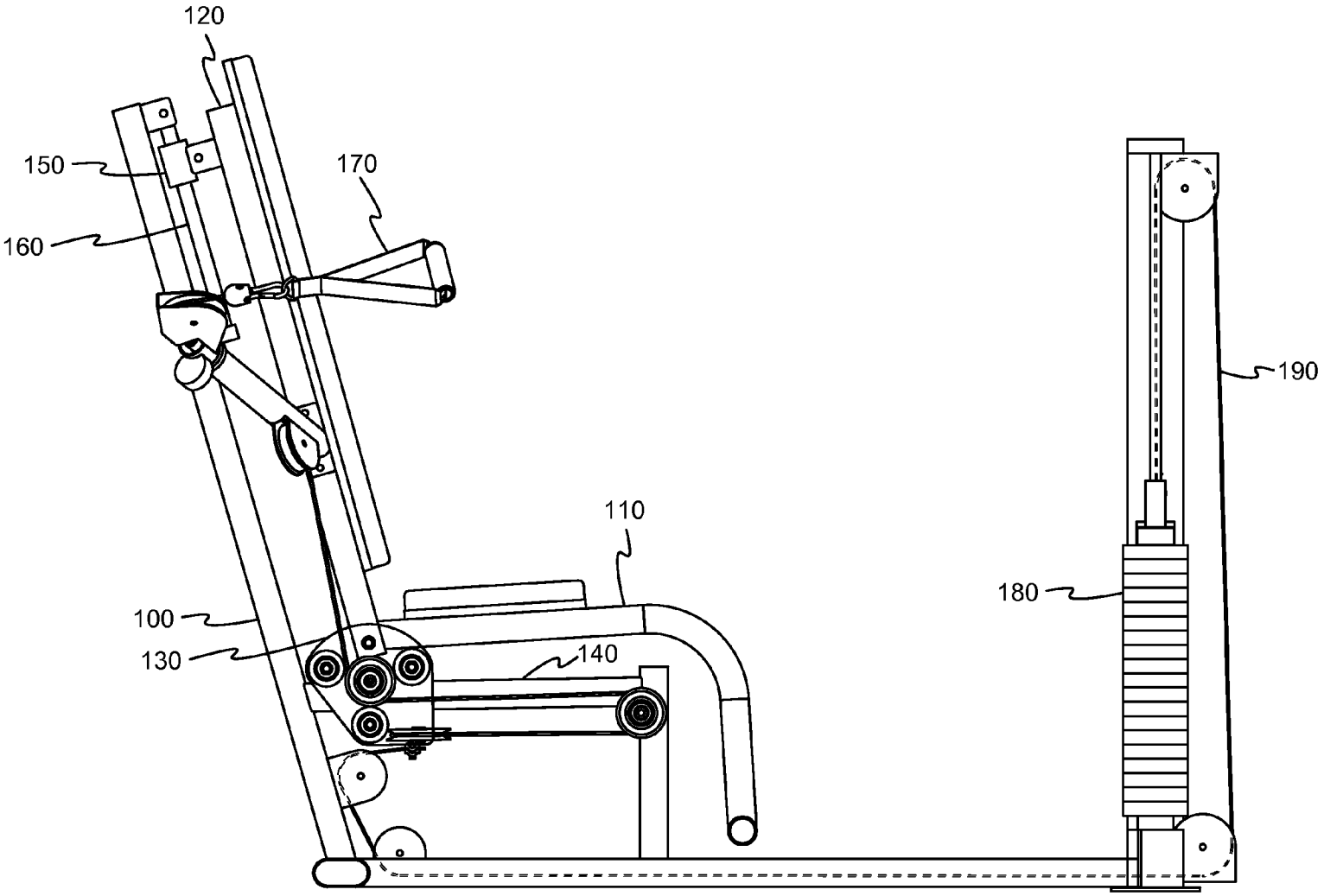
FIG. 1 illustrates a side view of a chest press machine according to an exemplary embodiment of the invention in a start position.

The following detailed description is of the best currently contemplated modes of carrying out exemplary embodiments of the invention. The description is not to be taken in a limiting sense, but is made merely for the purpose of illustrating the general principles of the invention, as the scope of the invention is best defined by the appended claims.

Various inventive features are described below that can each be used independently of one another or in combination with other features. Broadly, some embodiments of the present invention generally provide exercise equipment that puts a user through a natural, progressive motion. Such equipment may include a circuit of individual cable driven machines that allows the user to define a course of exercise.

The movement created using an arcing progression of some embodiments triggers compound muscle interaction that includes core stabilization and peripheral muscles. Coupling the arc movement of some embodiments and unrestricted cable driven action improves balance and functional movement, ensures compound muscle interaction, and supports the user in an optimal biomechanical position thought the entire exercise.

Such functional movements include activities like manually opening or closing a garage door; replacing or removing heavy objects on a high shelf; placing or pulling object in and out of the trunk of a car; getting up from or sitting down in a chair; getting in or out of a bathtub; pulling a water hose across a yard; pushing a lawnmower; or even lifting and holding a child or pet.

Several more detailed embodiments of the invention are described in the sections below. Section I provides a conceptual description of the theory of operation of some embodiments and a description of an example design process. Section II then describes various specific machines that may be provided by some embodiments.

I. Theory of Operation

Sub-section I.A provides a conceptual description of various elements associated with body position in some embodiments. Sub-section I.B then describes various resistance elements included in some embodiments. Lastly, subsection I.C describes an example design implementation of a specific machine.

A. Body Position Elements

Some embodiments provide a fixed user support. Such a support may be generally "L"-shaped and may allow a user to sit or recline on an apparatus while having his or her body supported in an optimized position for performing the exercise. Different embodiments may include different specific support elements. For instance, such supports may have different angles between a seat portion and a back portion of the supports. As another example, different embodiments may include different sets of cushions or other appropriate elements.

In some embodiments, various elements of the fixed support may be adjustable (e.g., a seat height setting may be selected from among a number of options).

Some embodiments provide a first body movement element. Such an element may include a carriage system driven and tracked via a linear stabilizing shaft. In addition, some embodiments may include a second body movement element. Such an element may include a fixed column or other appropriate support and an attachment element that is able to move along the column such that the fixed user support maintains an appropriate body position as the support moves along the first body movement element.

In some embodiments, the body movement elements may be at least partially adjustable. For instance, a user may be able to set start or end points along the movement path, a user may be able to adjust the angle of a body movement element relative to the user support, etc. In some embodiments, the adjustable elements may allow a user to align a joint with a machine feature (e.g., a knee with a pivot point on a leg curl machine).

Such body movement elements may allow a user to sustain a natural body arcing progression during a movement. In addition, the system may provide a consistent, smooth resistance throughout the entire exercise.

By combining multiple body movement elements, users are able to benefit from an "unrestricted" progression of compound muscle movements, activating crucial core stabilization muscles, in order to replicate, "real life" functional activities.

B. Resistance Elements

Some embodiments may include a cable driven, weight stack resistance movement element. Many implementations may include a pair of handles (and/or other appropriate user interface element such as a foot plate, a bar, a roller, etc.), where each handle is attached to a cable end. The free cable ends may allow a user to move each handle along an arbitrary path, which may allow a more comfortable movement and/or engage additional muscle groups.

Each cable may utilize a set of pulleys and/or connect to one or more other cables or elements. In some embodiments, in addition to using the cable system to move selected weight stack resistance elements, the cable system may be used to move the user along a movement path defined by the body movement elements described above.

Some embodiments may be configured such that the body weight of the user provides additional resistance to the weight stack resistance. Alternatively, some embodiments may be configured such that the body weight of the user provides assistance in moving the weight stack resistance. Some embodiments may be configured such that the amount of additional resistance and/or assistance may vary across the movement path.

One of ordinary skill in the art will recognize that various other specific resistance elements or selectable loads may be included in some embodiments (e.g., body weight only, resistance bands, free weight attachment points, etc.).

C. Example Design

The features described above will be illustrated by reference to the example machines of FIGS. 1-15. The first example is a chest exercise machine 100 that may be used for chest press and/or chest fly exercises. This example will describe a chest press exercise using the chest exercise machine.

Figure 2:
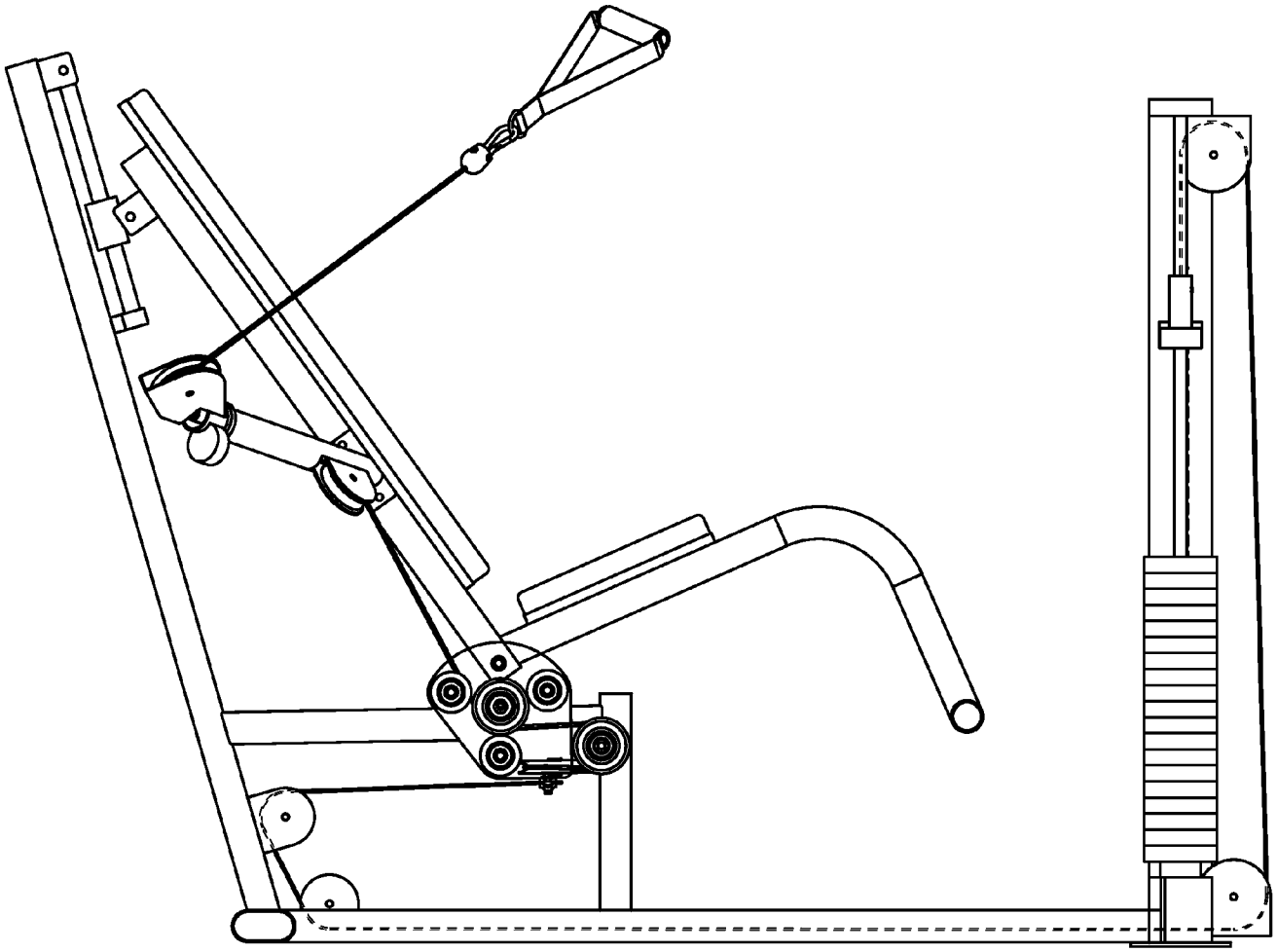
FIG. 2 illustrates a side view of the chest press machine in an end position.
Figure 3:
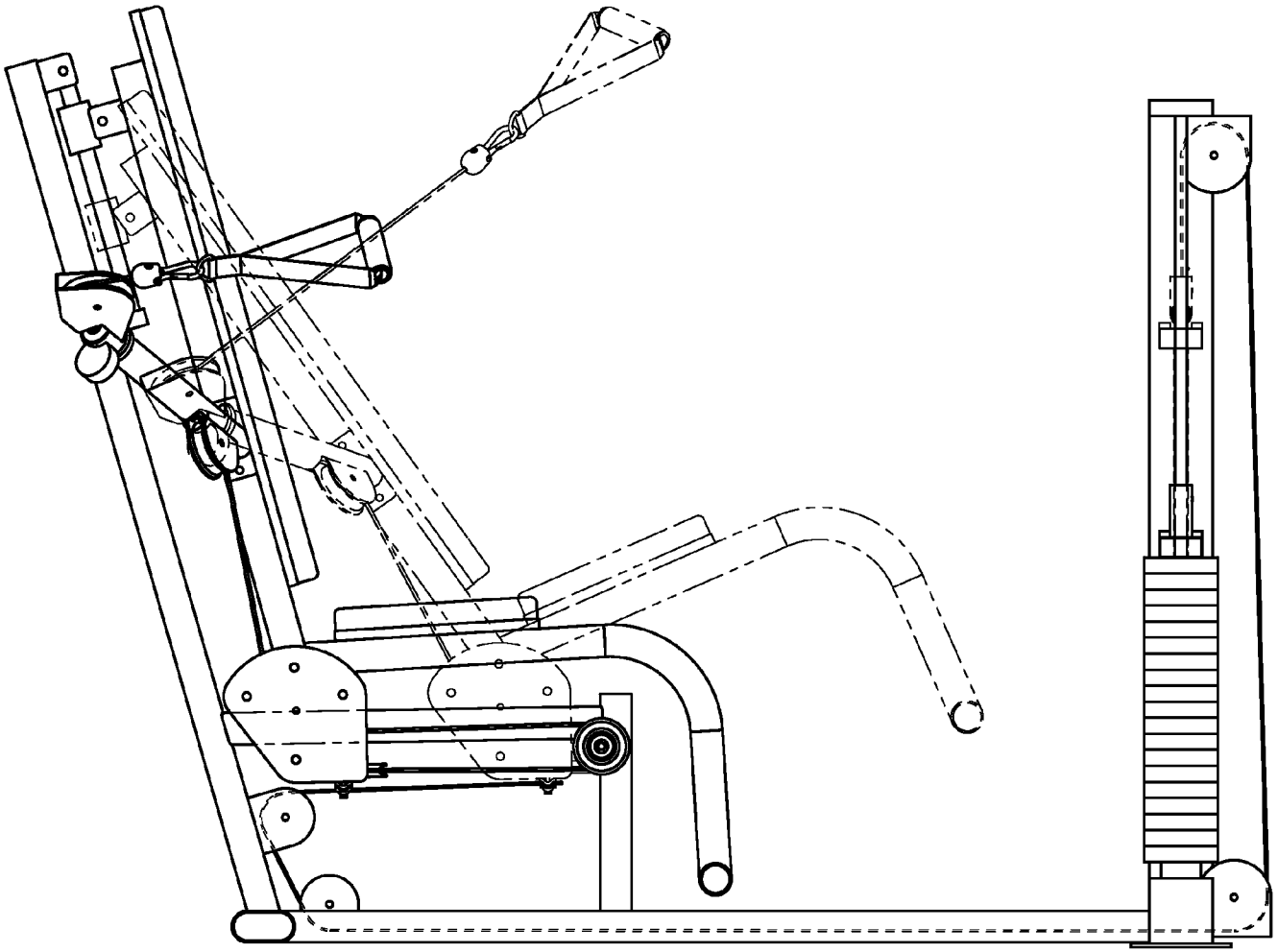
FIG. 3 illustrates a side view of the chest press machine showing the relative arrangements of the start position and end position.

FIG. 1 illustrates a side view of a chest press machine 100 according to an exemplary embodiment of the invention in a start position. Such a start position may be, in addition to an exercise start position, a resting position of the machine. In other words, the machine may naturally remain in the start position when not being used. FIG. 2 illustrates a side view of the chest press machine 100 in an end position. FIG. 3 illustrates a side view of the chest press machine 100 showing the relative arrangements of the start position and end position.

Figure 4:
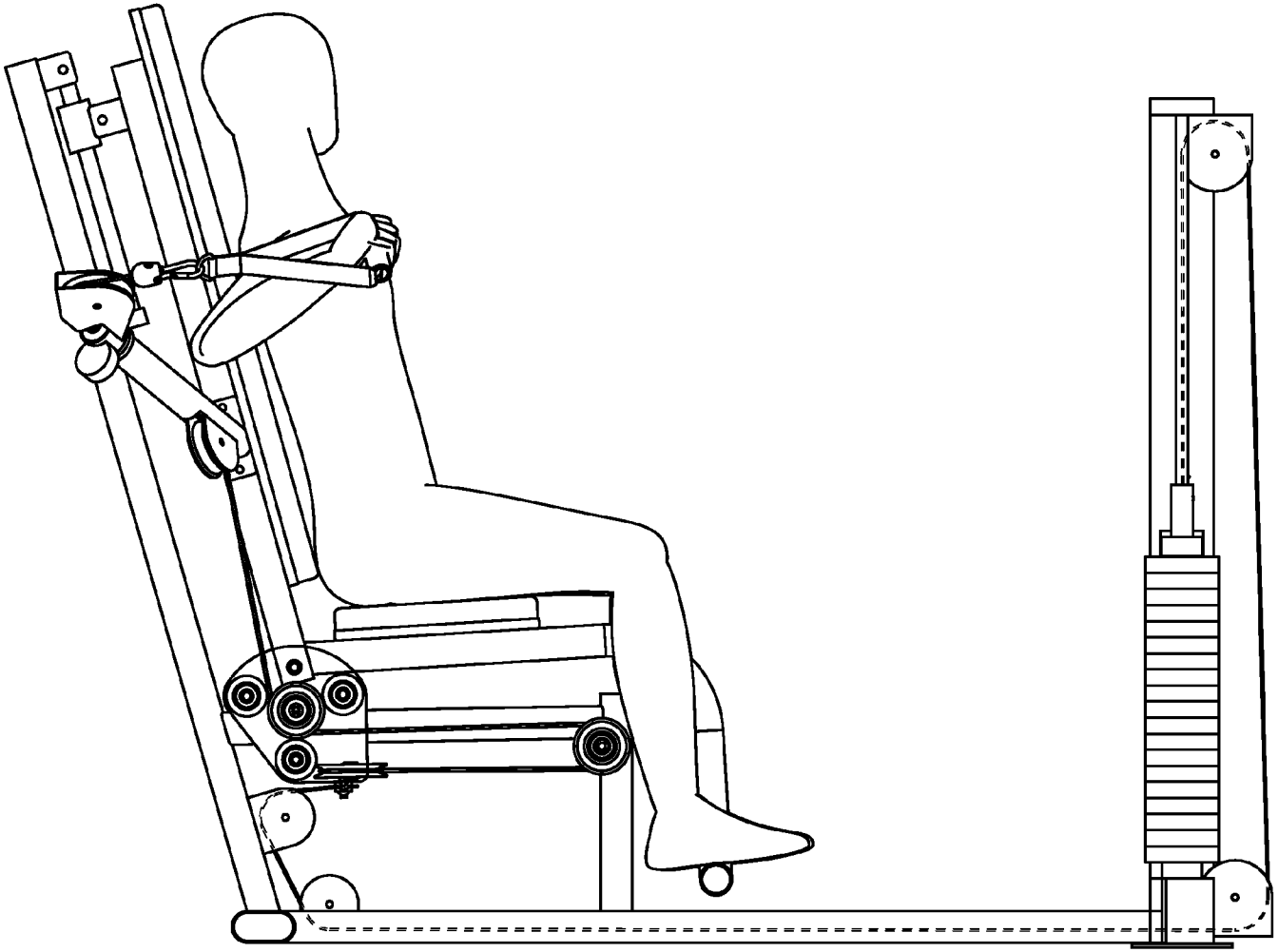
FIG. 4 illustrates a side view of the chest press machine in the start position during use.
Figure 5:
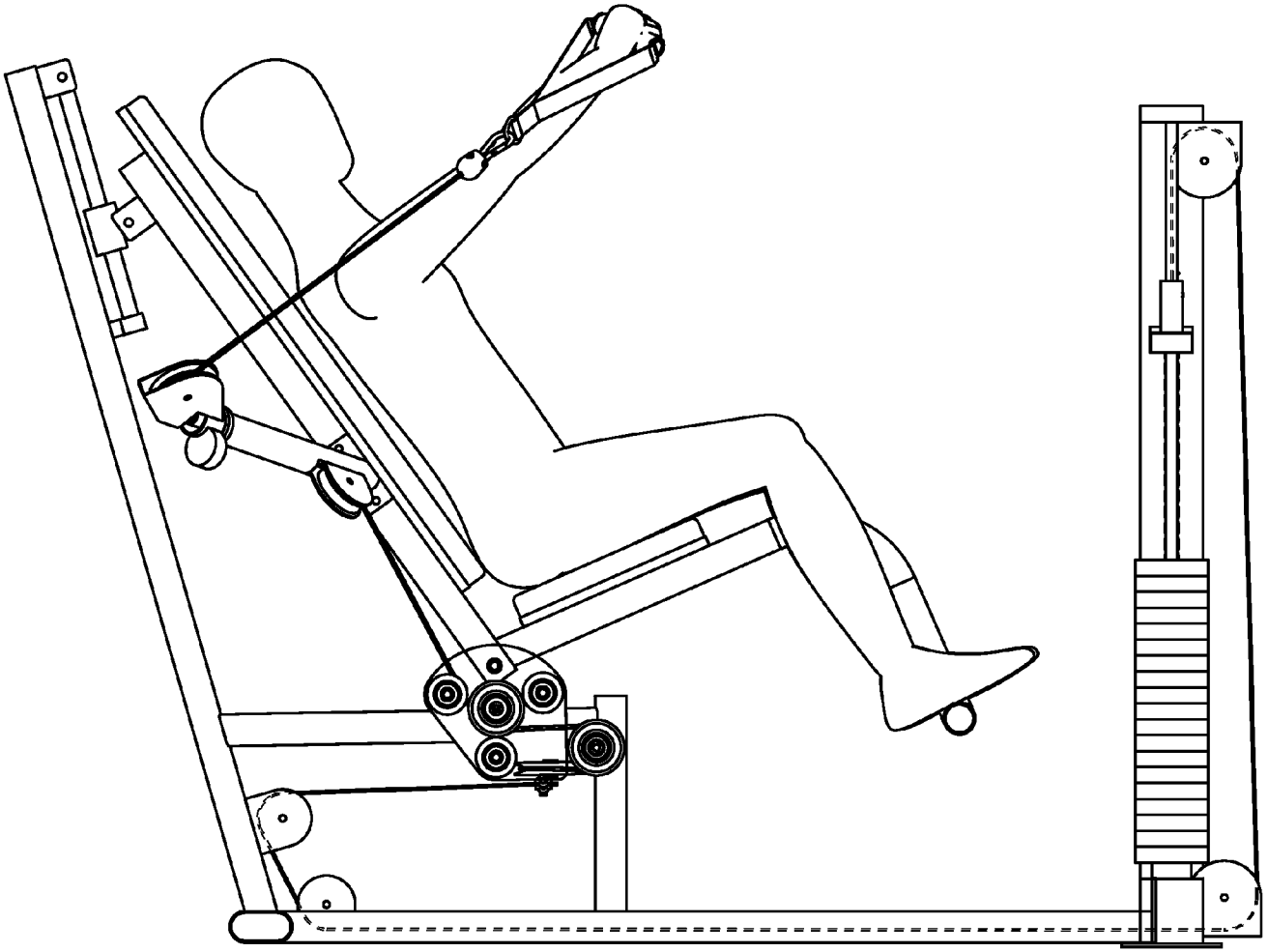
FIG. 5 illustrates a side view of the chest press machine in the end position during use.
Figure 6:
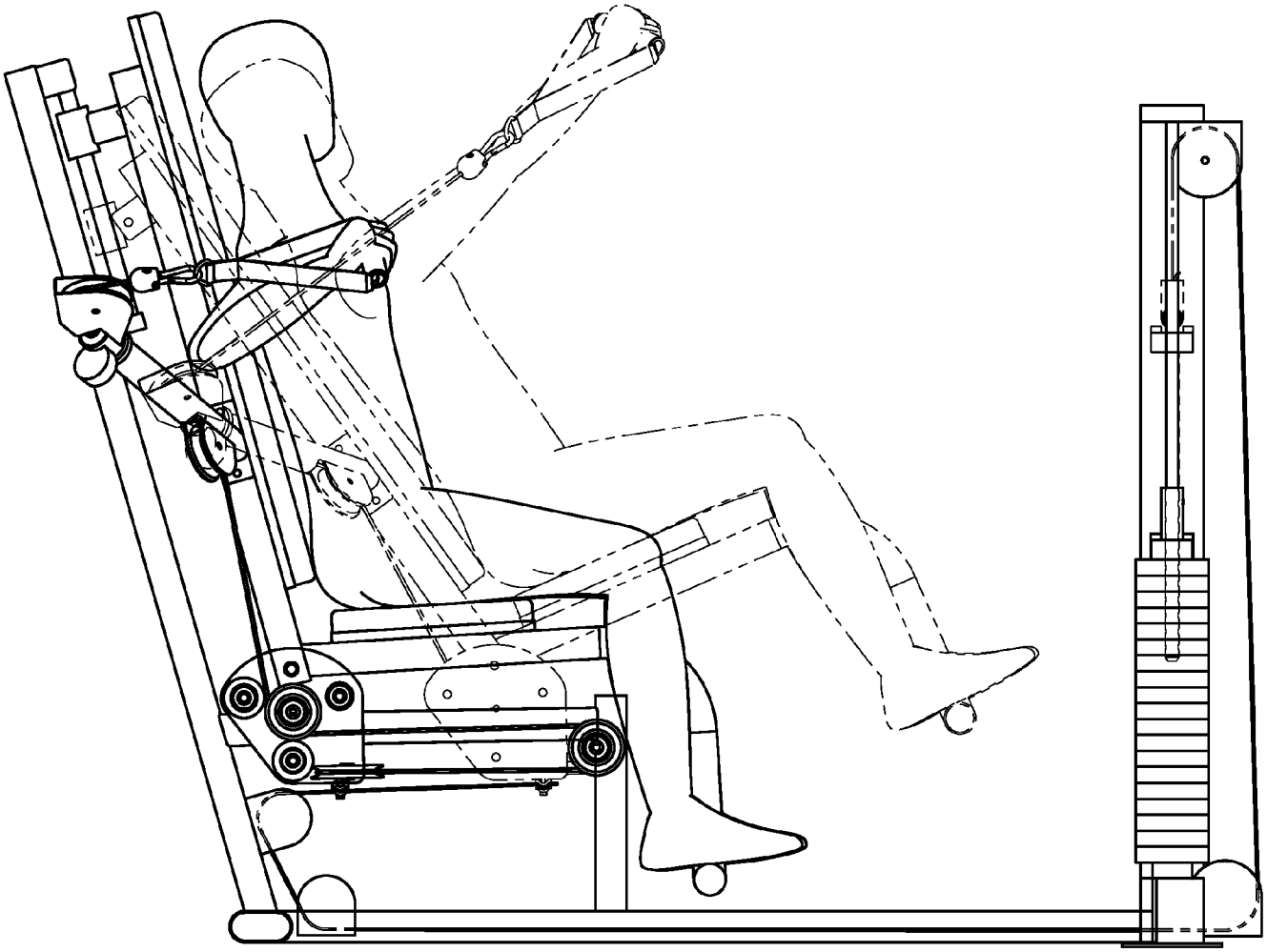
FIG. 6 illustrates a side view of the chest press machine showing the relative arrangements of the start position and end position during use.

FIG. 4 illustrates a side view of the chest press machine 100 in the start position during use. FIG. 5 illustrates a side view of the chest press machine 100 in the end position during use. FIG. 6 illustrates a side view of the chest press machine 100 showing the relative arrangements of the start position and end position during use.

Figure 7:
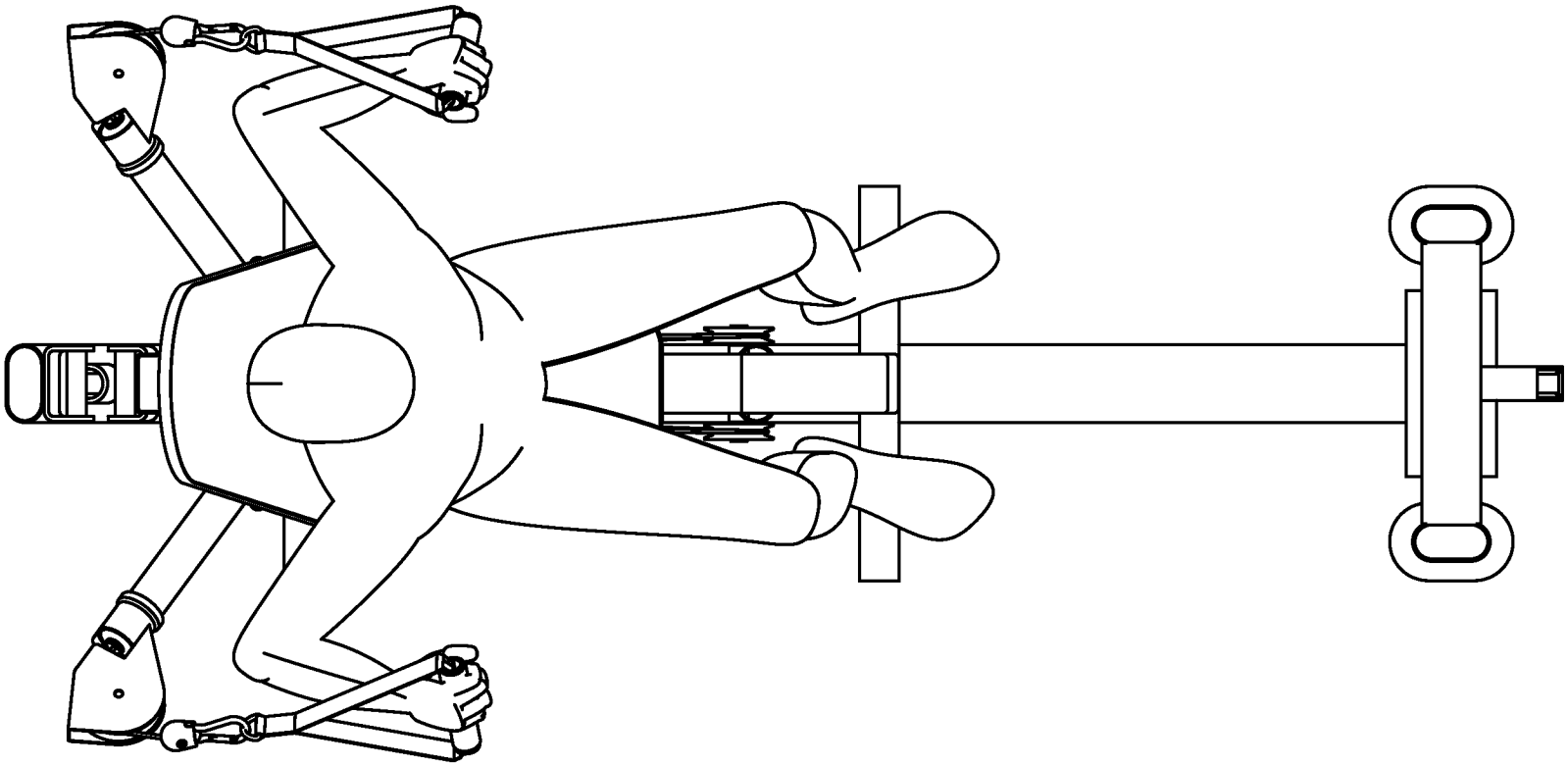
FIG. 7 illustrates a top view of the chest press machine in the start position during use.
Figure 8:
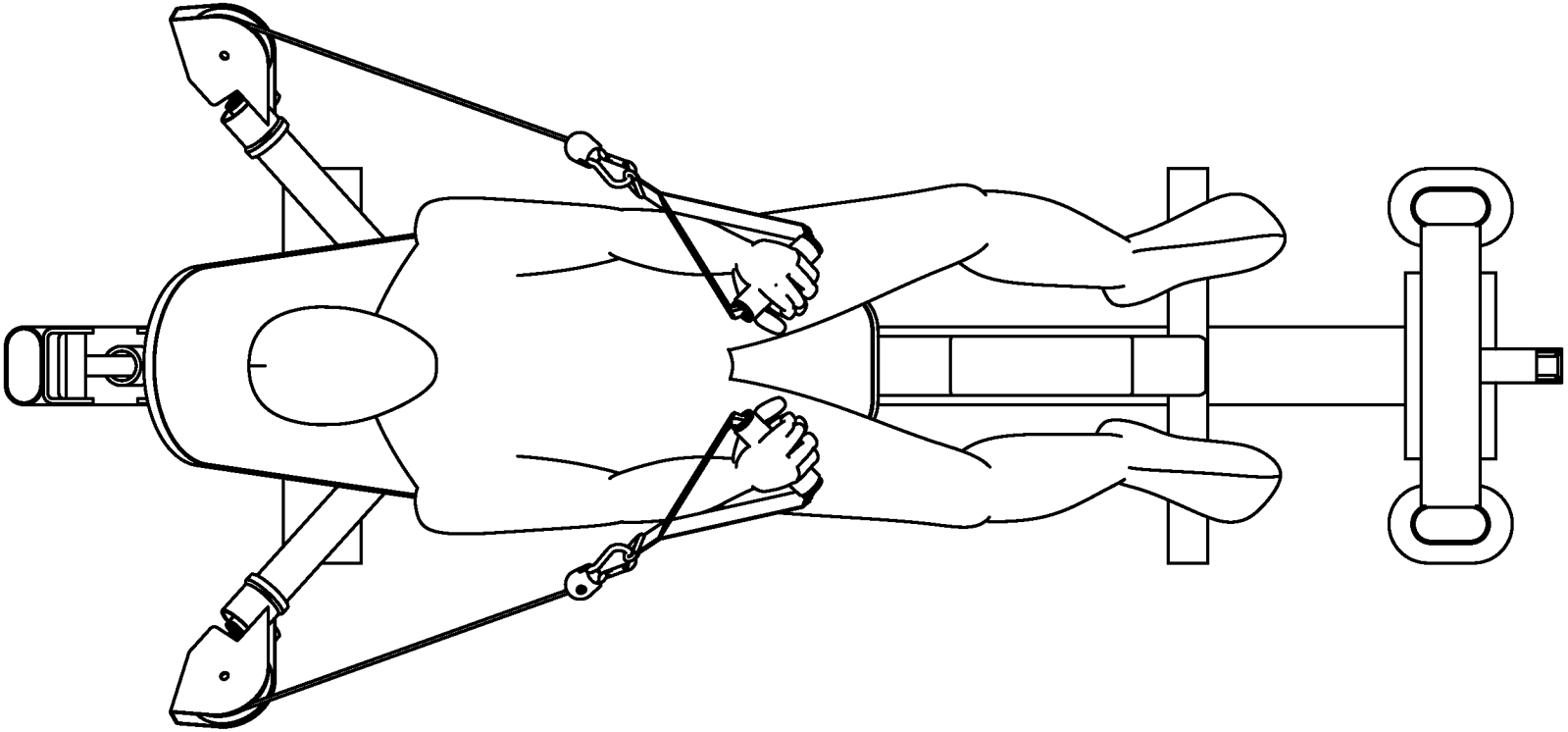
FIG. 8 illustrates a top view of the chest press machine in the end position during use.
Figure 9:
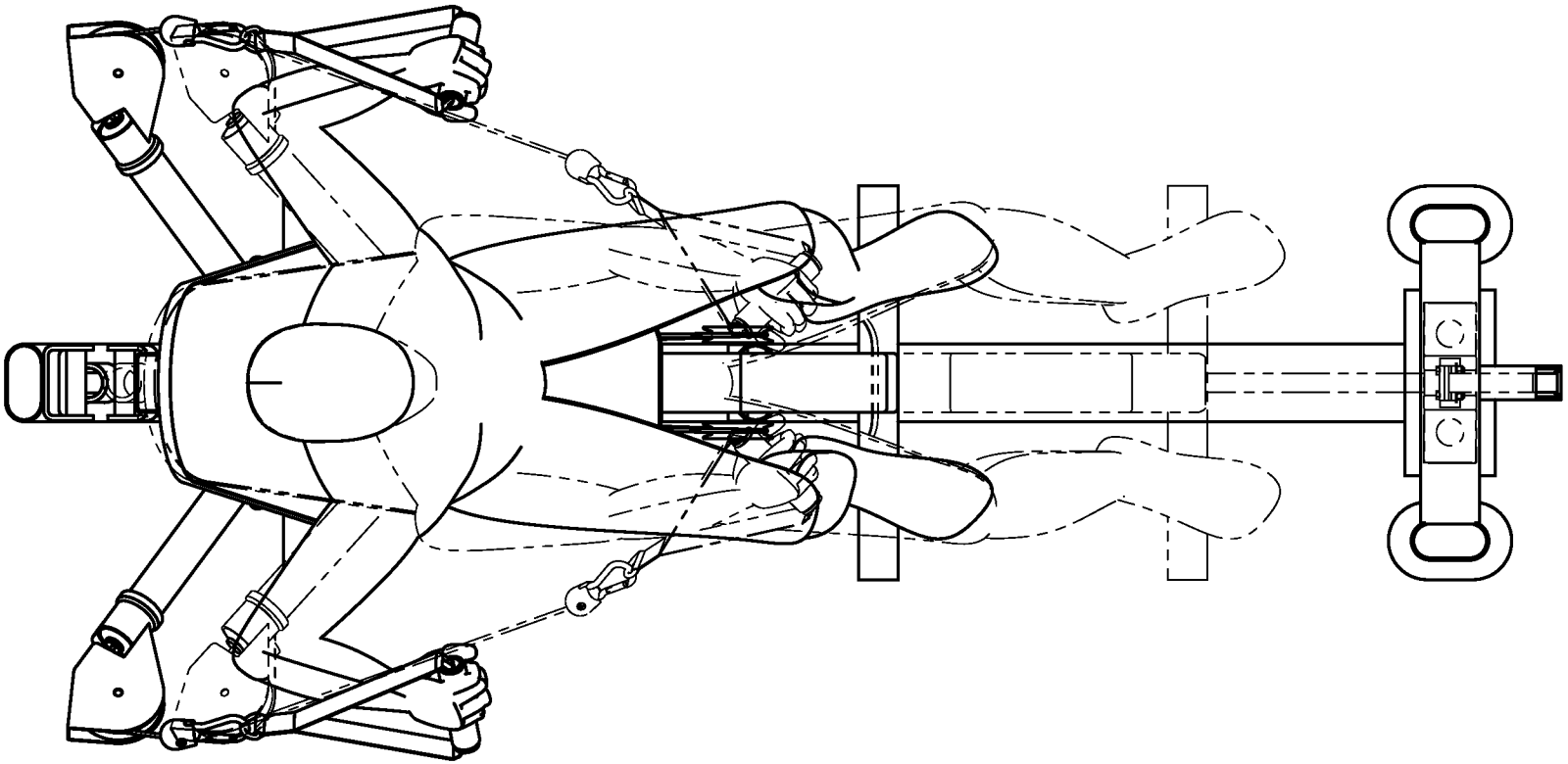
FIG. 9 illustrates a top view of the chest press machine showing the relative arrangements of the start position and end position during use.

FIG. 7 illustrates a top view of the chest press machine 100 in the start position during use. FIG. 8 illustrates a top view of the chest press machine 100 in the end position during use. FIG. 9 illustrates a top view of the chest press machine 100 showing the relative arrangements of the start position and end position during use.

Figure 10:
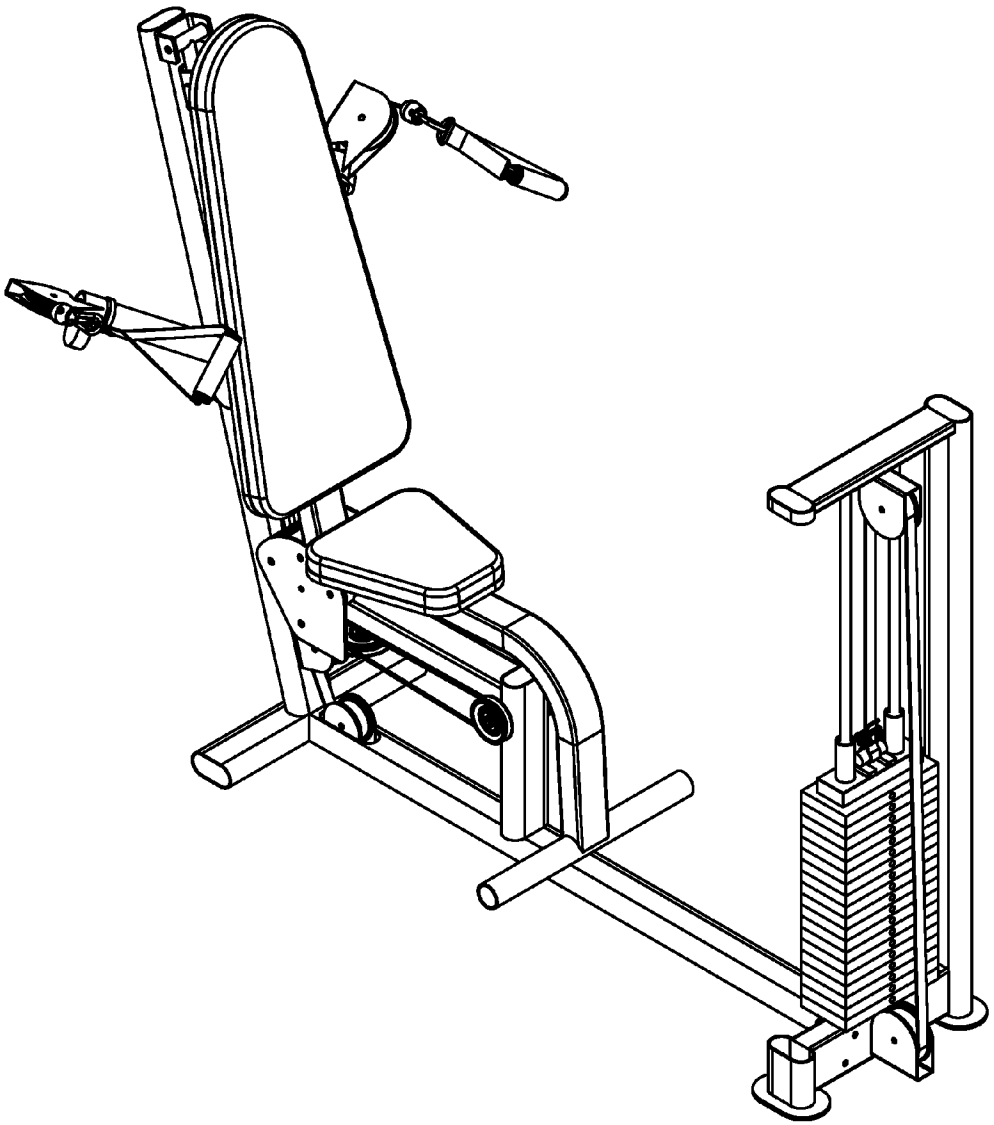
FIG. 10 illustrates a perspective view of the chest press machine in the start position.
Figure 11:
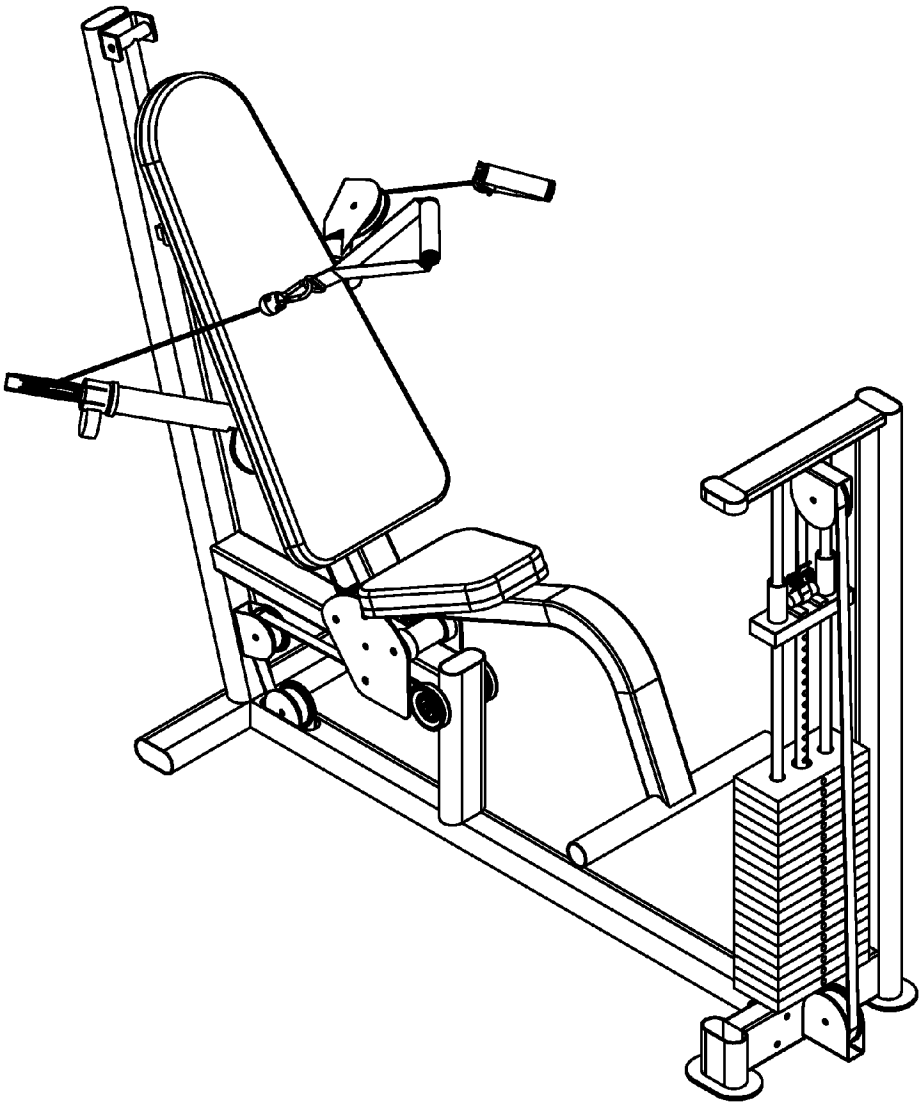
FIG. 11 illustrates a perspective view of the chest press machine in the end position.
Figure 12:
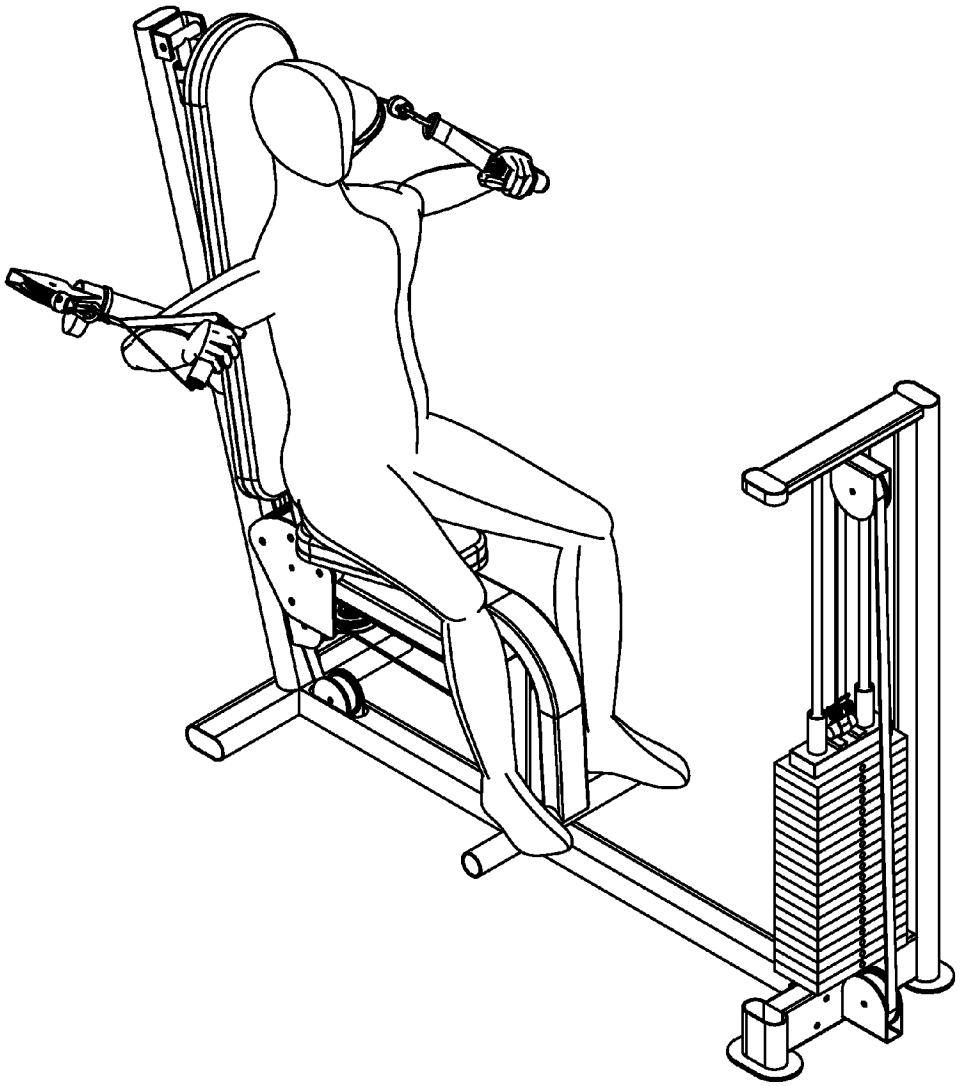
FIG. 12 illustrates a perspective view of the chest press machine in the start position during use.
Figure 13:
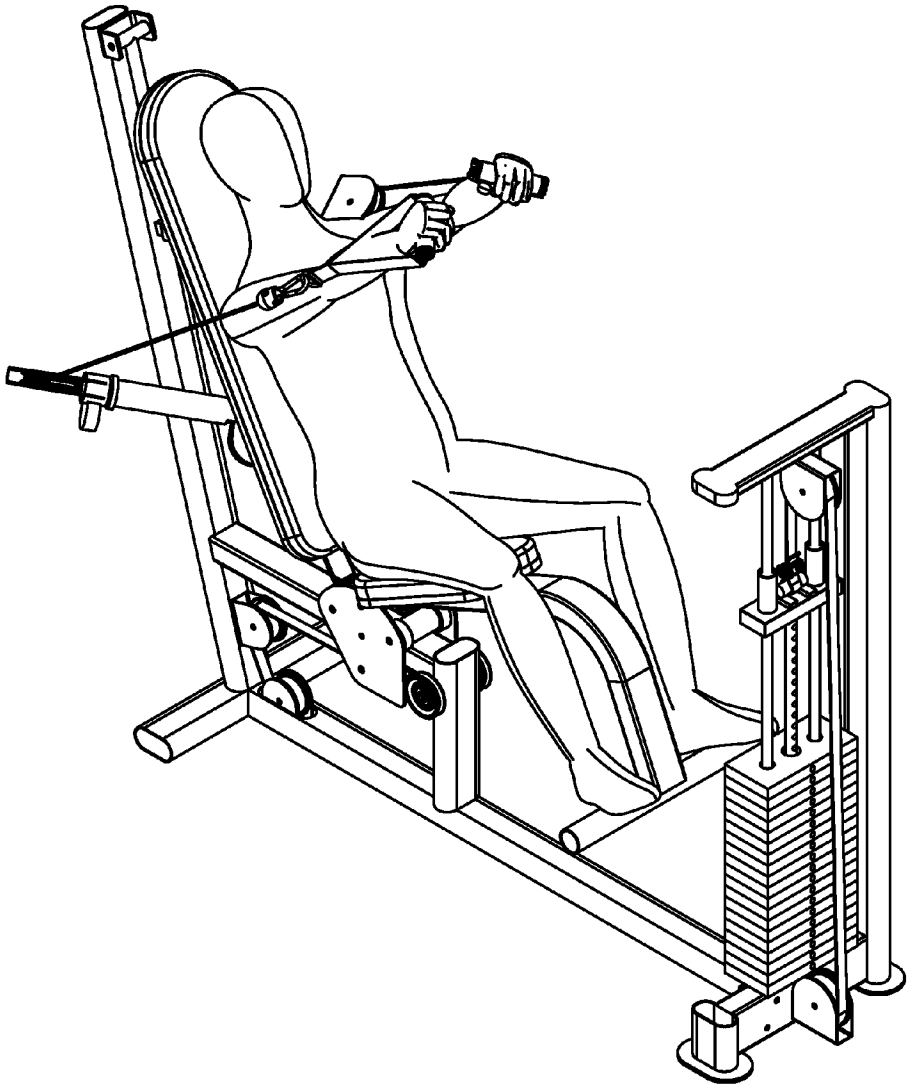
FIG. 13 illustrates a perspective view of the chest press machine in the end position during use.

FIG. 10 illustrates a perspective view of the chest press machine 100 in the start position. FIG. 11 illustrates a perspective view of the chest press machine 100 in the end position. FIG. 12 illustrates a perspective view of the chest press machine 100 in the start position during use. FIG. 13 illustrates a perspective view of the chest press machine 100 in the end position during use.

As shown, the cable resistance machine 100 may put the user in a seated starting position and, as the handles are moved away from the user's body, deliver a natural forward and return arcing progression applying a continuous and equal amount of resistance. Such a machine may engage the user's chest, shoulders, triceps and core stabilizing muscles during the movement.

The machine 100 may include a fixed user support having a seat 110 and back support 120, a first movement element having a carriage 130 and rail 140 (and/or other appropriate element such as a shaft), a second movement element having a moving attachment element 150 and a fixed column 160, a set of handles 170, a weight stack 180, and a cable system 190.

The machine frame 100 may be formed by various appropriate elements such as beams, tubes, brackets, etc. The frame elements may be arranged in various appropriate ways, as shown. Many frame elements may be fixed-position elements used to support moving elements such as the user support (via the movement elements), a weight stack, cables, etc. Moving elements such as pulleys may be attached to the frame and included as part of a resistance path used by the machine.

The seat 110 and back support 120 may be arranged in various appropriate ways (e.g., with different lengths, connection angles, etc.). In addition, in this example, the user support may include a footrest. In some embodiments, the supports may include adjustable elements that may allow a user to align a joint with a machine feature (e.g., a knee with a pivot point on a leg curl machine) and/or otherwise adjust the user position (e.g., by raising or lowering the seat 110 to adjust for a user's height).

The user support defined by the seat 110 and back support 120 may include a pivot axis associated with a connection to the carriage 130. Likewise, the attachment element 150 may include a pivot axis. Thus, as shown, the angle of the user support relative to the other machine components may change along the movement path while the position of the user relative to the user support remains consistent.

In some embodiments the second movement element may include a member having one or more bend angles and multiple pivot points. In some embodiments, a first pivot point may be associated with an attachment of one end of the angled member to the machine body and a second pivot point may be associated with an attachment of a second end of the angled member to the fixed user support. In some embodiments the second movement element may be integrated with the user interface element. Examples of such configurations are described below in reference to FIGS. 29 and 42, for instance.

The carriage 130 may be any set of components that may allow the carriage to move along the rail 140. This example uses a carriage roller, and other embodiments may include elements such as linear bearings, glides, etc. In some embodiments, the first movement element may include one or more resistance elements (e.g., a linear resistance bar).

In this example, the rail 140 is parallel to the ground while the column 150 forms an obtuse angle with the seat 110. Different embodiments may include different specific configurations. For instance, an alternative chest press machine having a slanted rail is described below in reference to FIG. 14.

The movement path along the rail 140 may be at least partly defined by attributes of the rail (e.g., slope, length, etc.). Likewise, the movement path along the column 160 may be at least partly defined by attributes of the column (e.g., slope, length, etc.). In addition, the movement path of the user may be at least partly defined by placement of the pivot axis relative to the attachment element 150 or seat back 120 and/or the pivot axis relative to the carriage 130 or seat 110. In some embodiments, any or all of these elements may be adjusted by a user (e.g., slope of the rail may be changed, a connection element may be repositioned, etc.).

Figure 14:
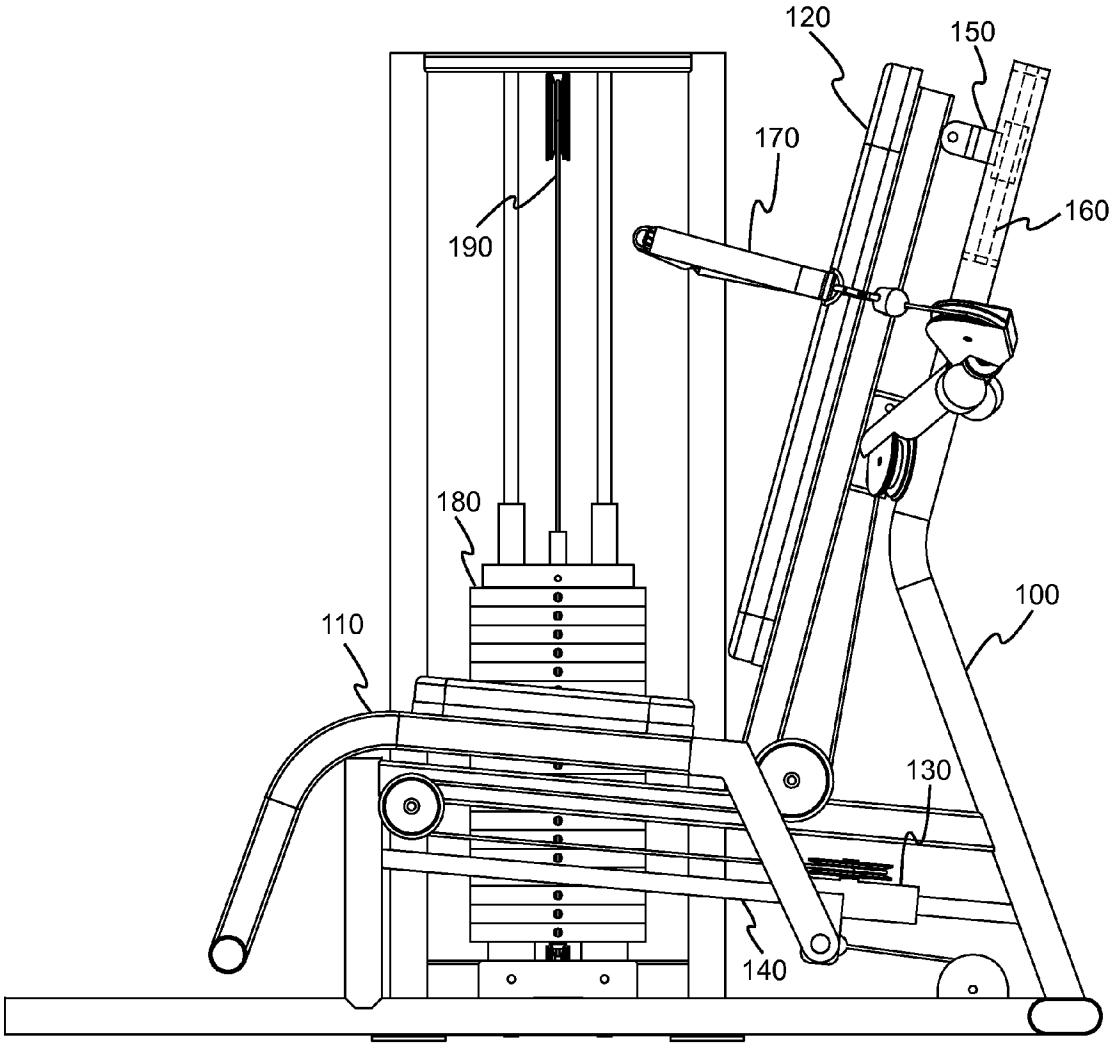
FIG. 14 illustrates a side view of an alternative chest press machine according to an exemplary embodiment of the invention in a start position.
Figure 15:
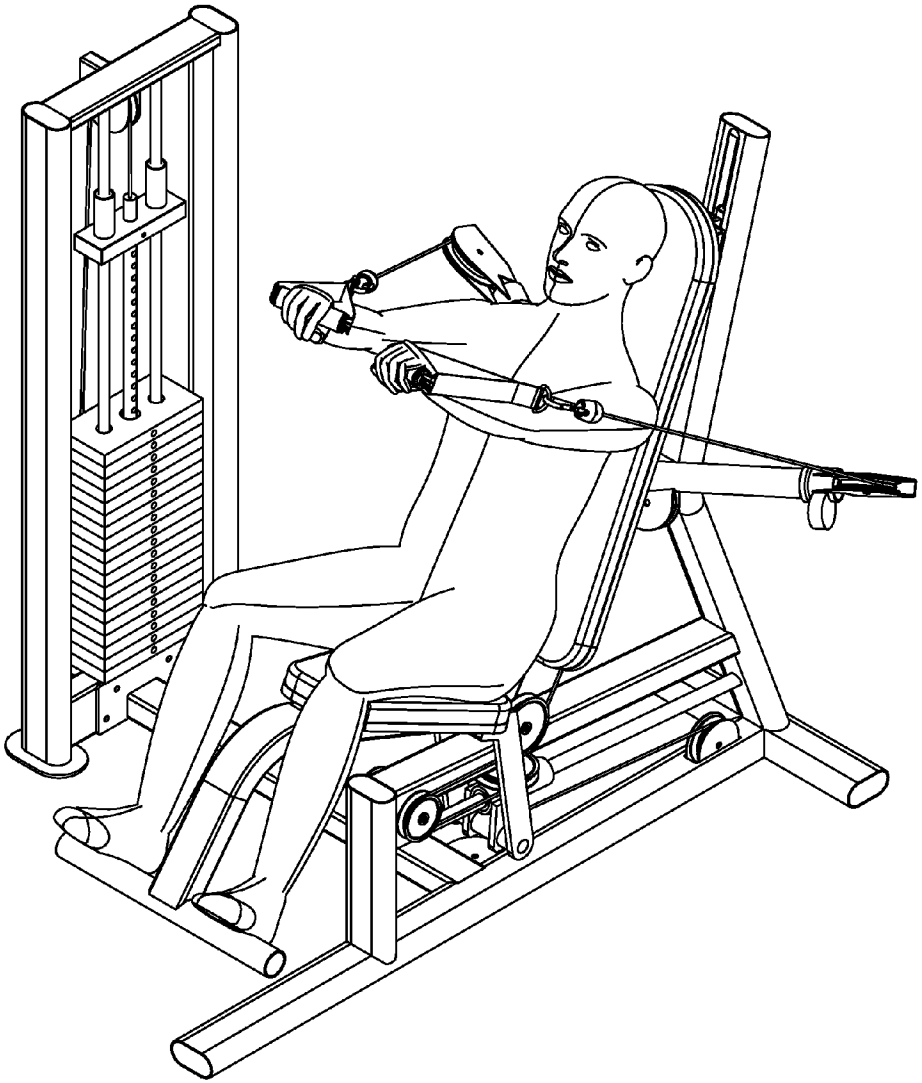
FIG. 15 illustrates a perspective view of the alternative chest press machine in the end position during use.

FIG. 14 illustrates a side view of an alternative chest press machine 100 according to an exemplary embodiment of the invention in a start position. FIG. 15 illustrates a perspective view of the alternative chest press machine 100 in the end position during use.

As above, the machine 100 may include a fixed user support having a seat 110 and back support 120, a set of handles 170, a weight stack 180, and a cable system 190.

In this example, the first movement element includes a linear bearing as a carriage 130 and an associated shaft that serves as the rail 140. The second movement element includes a moving attachment element 150 and a fixed column 160. In this example, the column 160 is located within a frame member of the machine 100.

The rail 140 in this example slopes upward as the movement progresses, while the column 160 is aligned at an obtuse angle compared to the seat 110.

In addition, the example of FIGS. 14-15 includes a weight stack 180 that is positioned to the side of the user support. Such an arrangement may allow a user to adjust the amount of resistance while seated on the machine 100. In addition, such an arrangement may reduce the floor space required by the machine.

A single machine may be used to perform multiple exercise movements. In some embodiments, the machine may be adjusted in various ways (e.g., support arms or other features may be arranged such that cable and/or handle positions are changed, a support angle or position may be changed, a movement element may be repositioned, etc.) to perform various different movements.

Alternatively, a user may apply a different movement path to use the same machine to perform different movements without any adjustments to the machine itself. For instance, a user may perform a chest fly movement rather than a press movement by varying arm position, elbow angle, etc.

Although the theory of operation has been described by reference to particular machines, one of ordinary skill in the art will recognize that different machines may be implemented in various different ways. Several such machines are described in Section II below.

II. Exemplary Machines

Sub-section II.A provides a conceptual description of a leg press machine of some embodiments. Next, sub-section II.B describes a seated leg curl machine of some embodiments. Sub-section II.C follows with a description of a leg extension machine of some embodiments. Lastly, sub-section II.D describes various other machines or elements that may be used by some embodiments.

A. Leg Press

Figure 16:
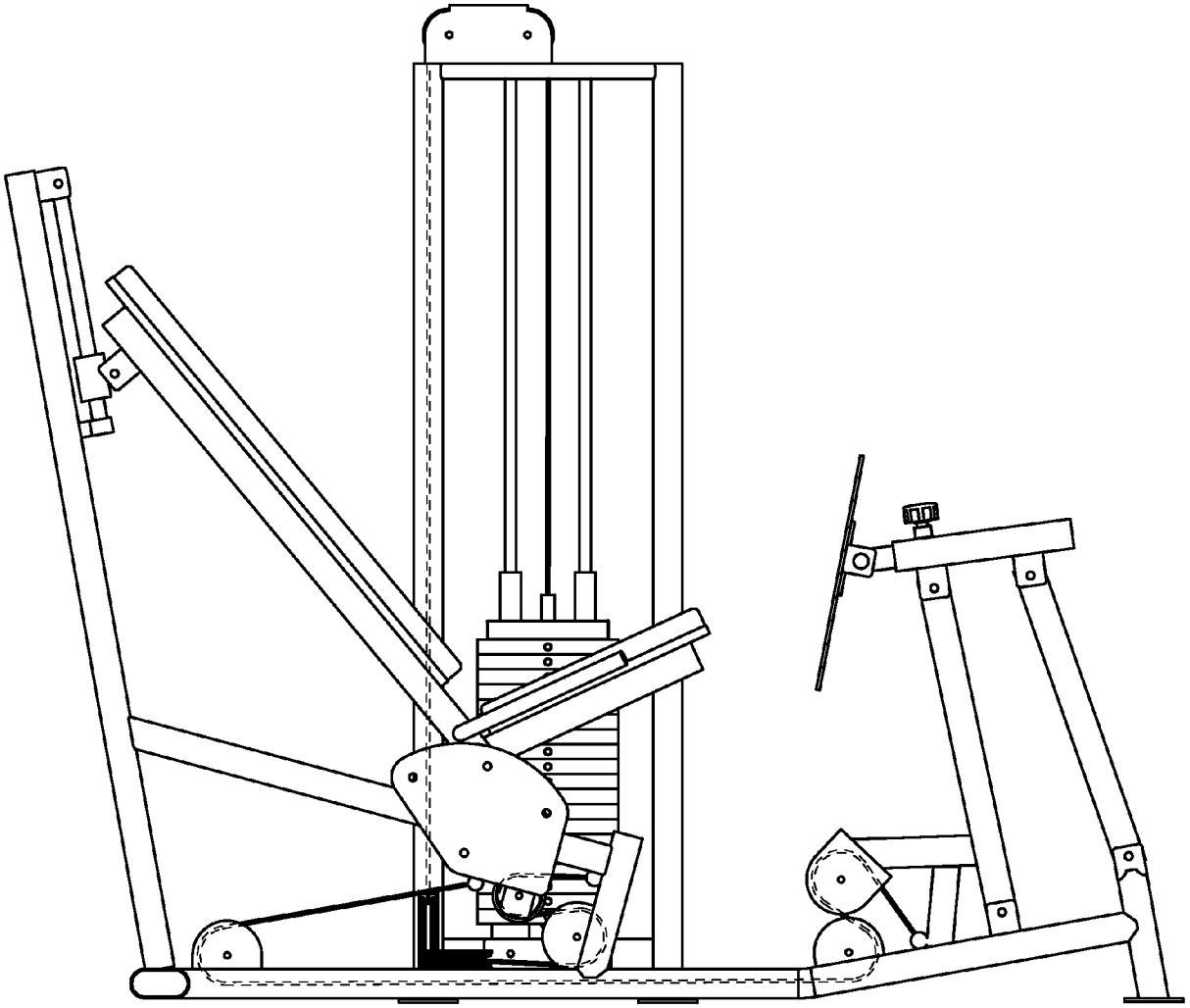
FIG. 16 illustrates a side view of a leg press machine according to an exemplary embodiment of the invention in a start position.
Figure 17:
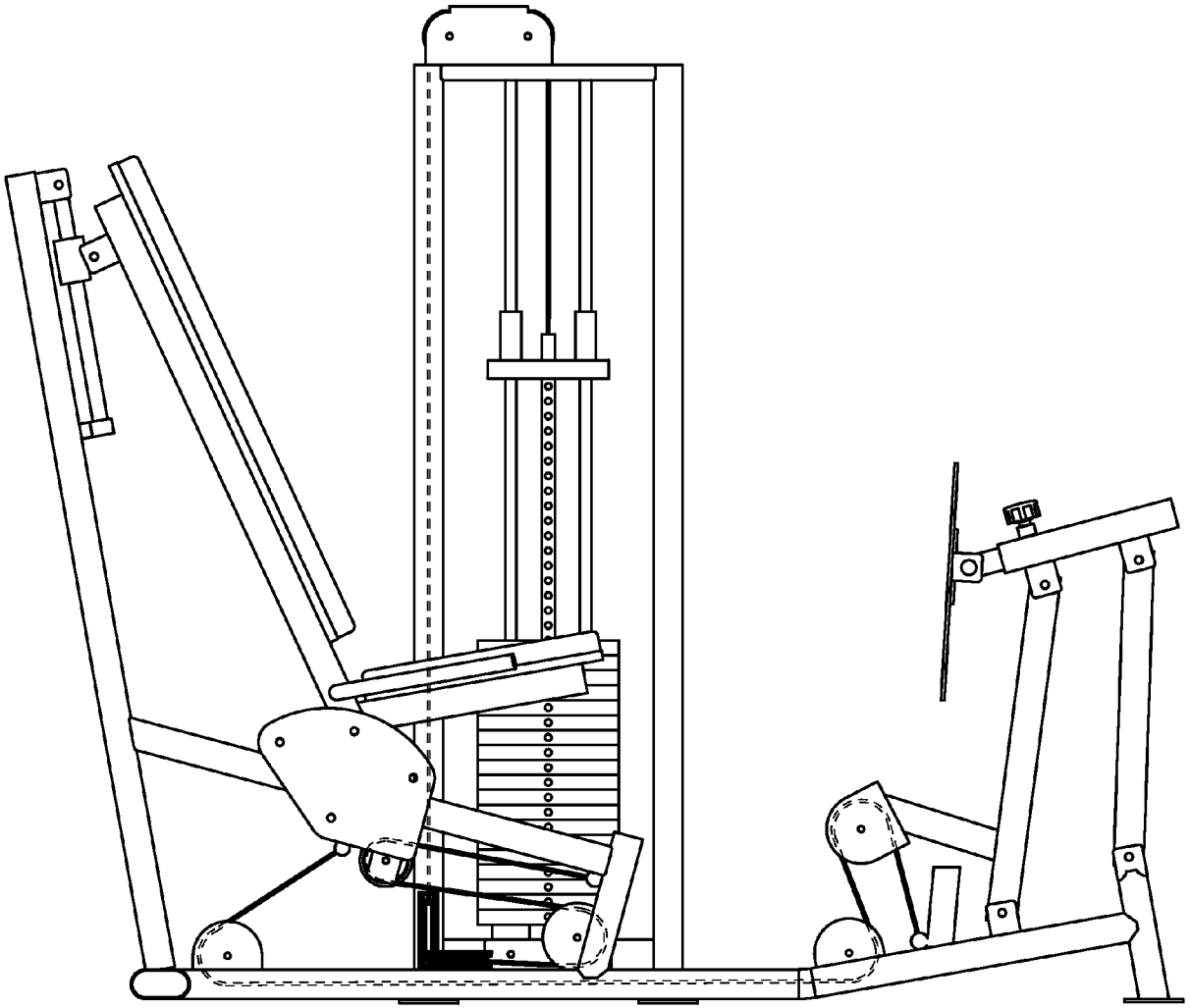
FIG. 17 illustrates a side view of the leg press machine in an end position.
Figure 18:
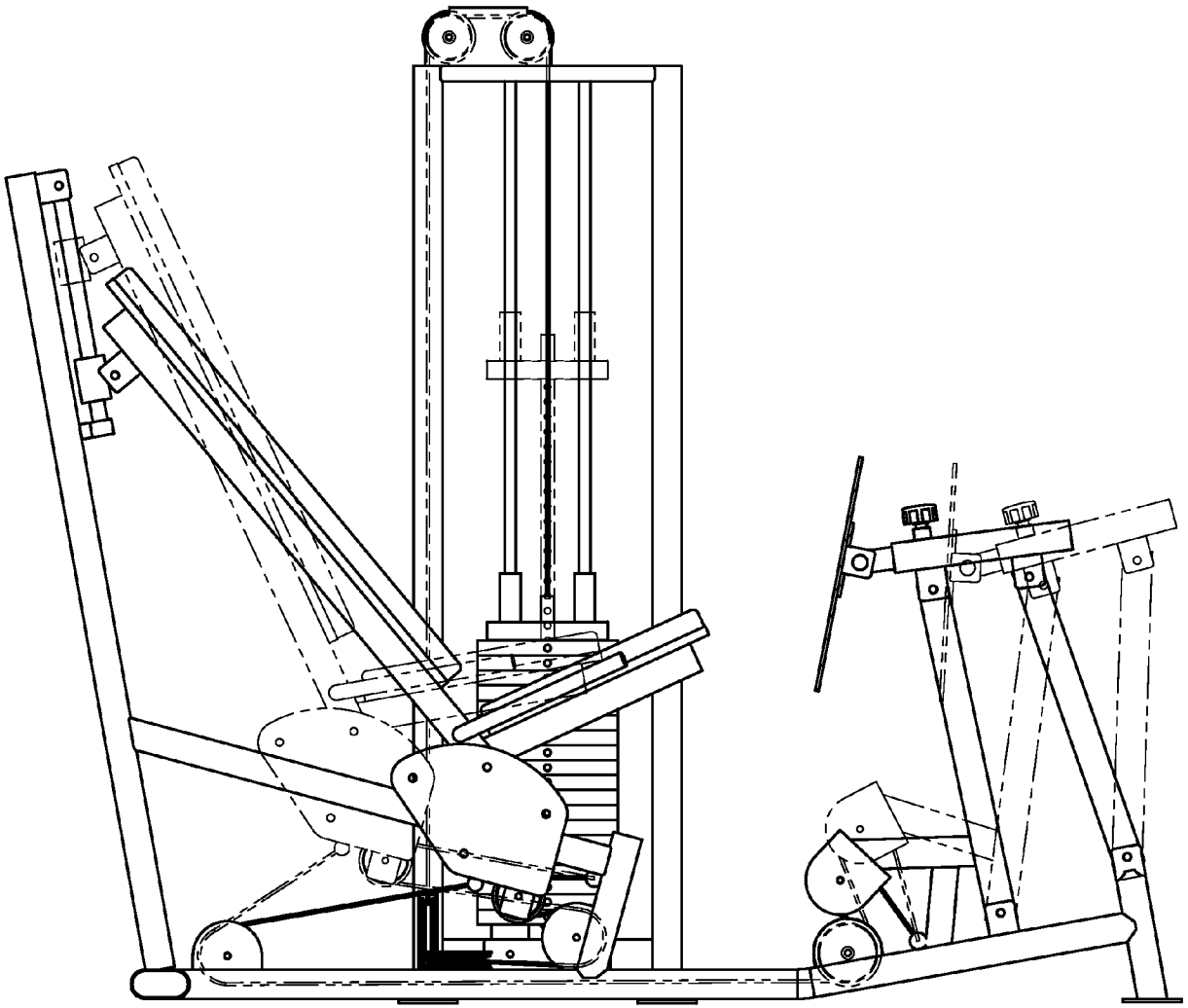
FIG. 18 illustrates a side view of the leg press machine showing the relative arrangements of the start position and end position.
Figure 19:
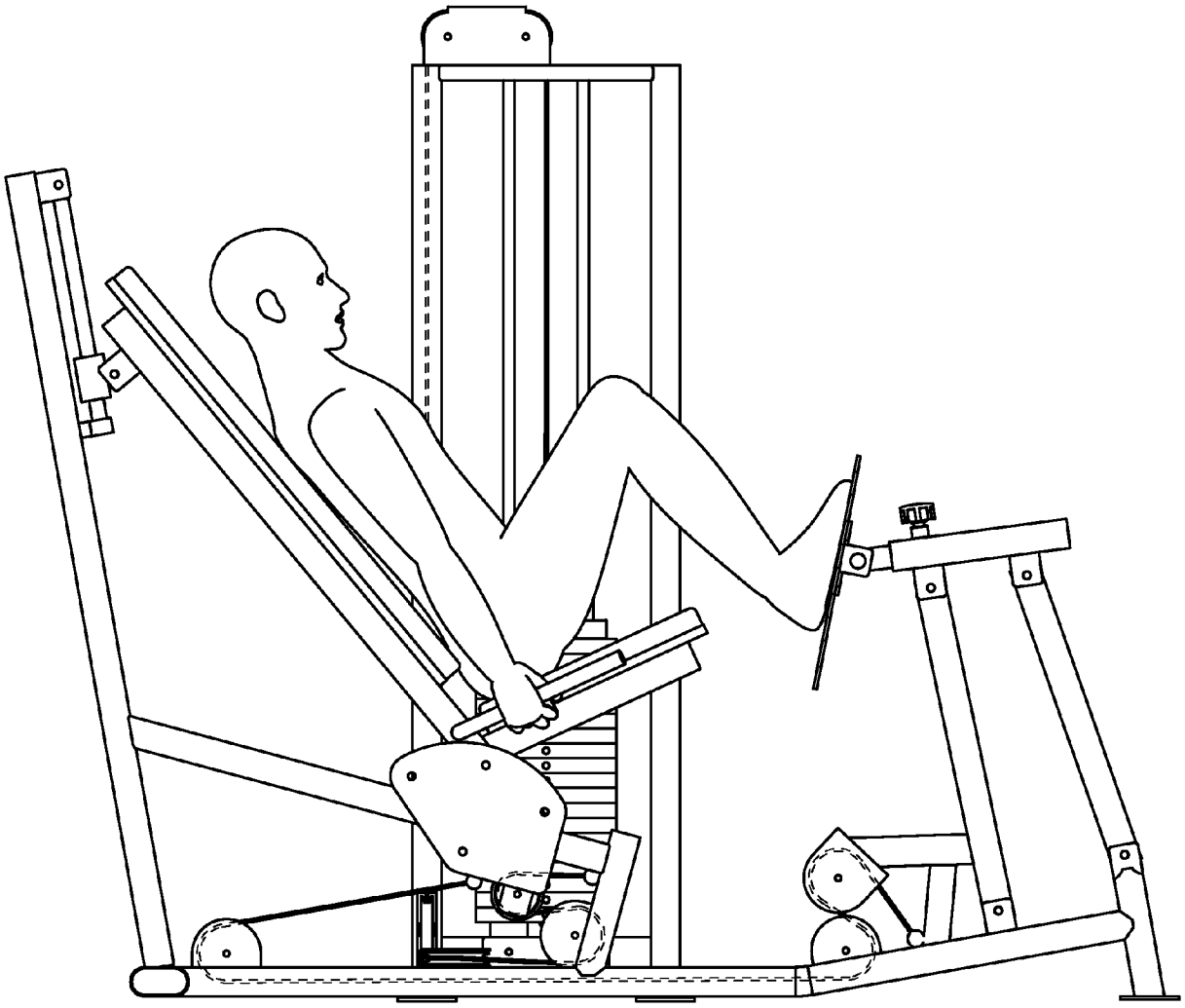
FIG. 19 illustrates a side view of the leg press machine in the start position during use.
Figure 20:
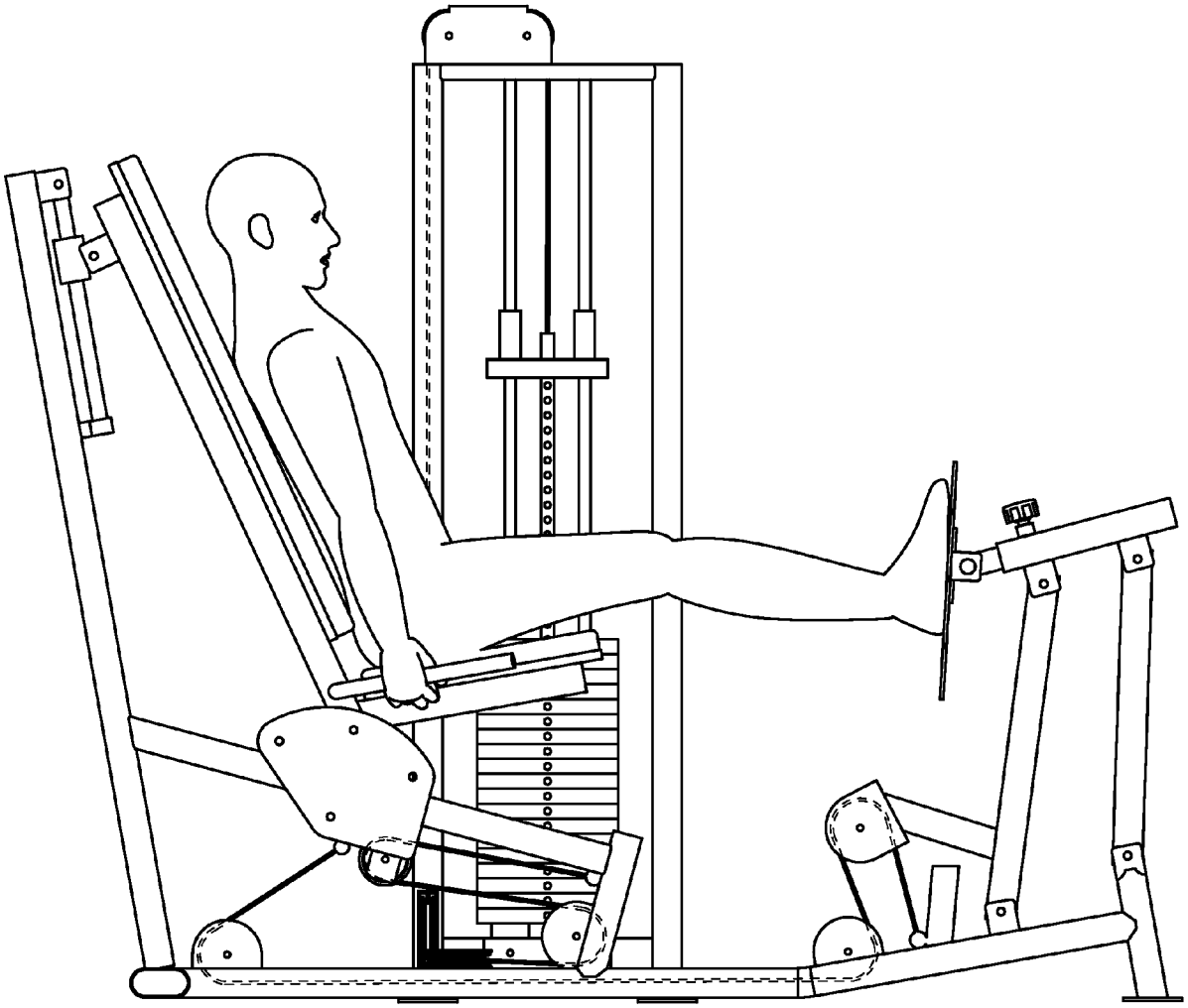
FIG. 20 illustrates a side view of the leg press machine in the end position during use.
Figure 21:
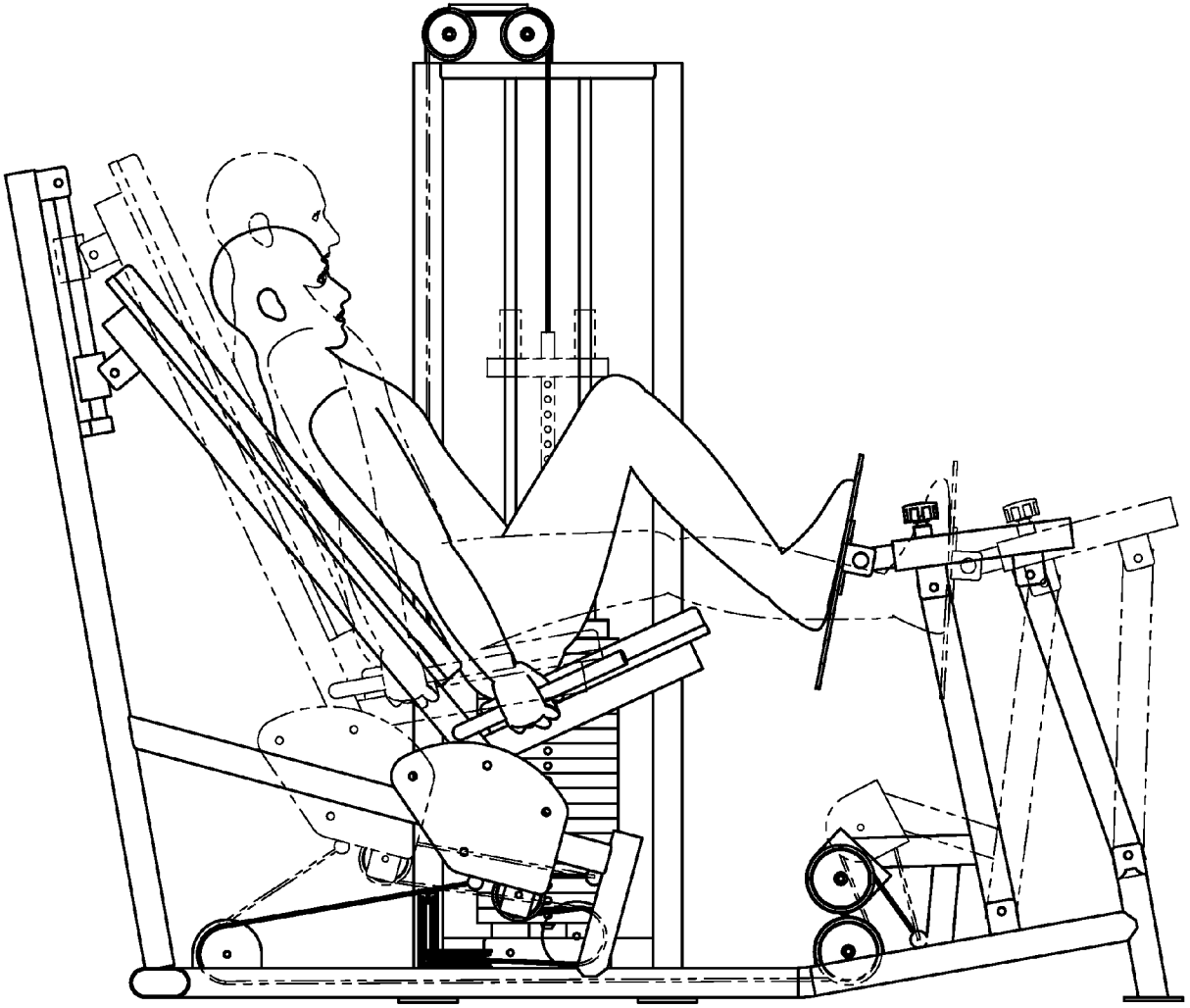
FIG. 21 illustrates a side view of the leg press machine showing the relative arrangements of the start position and end position during use.
Figure 22:
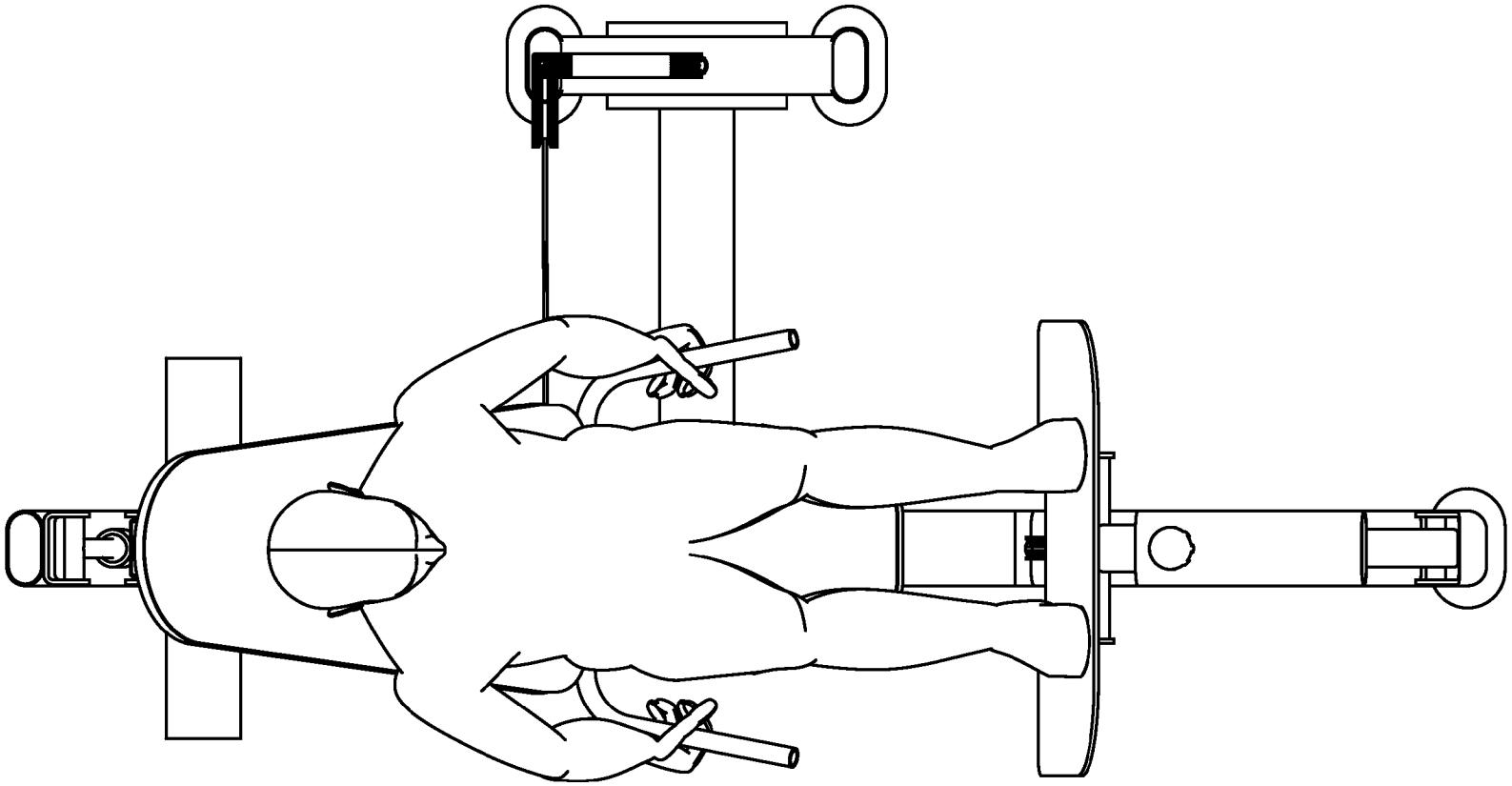
FIG. 22 illustrates a top view of the leg press machine in the start position during use.
Figure 23:
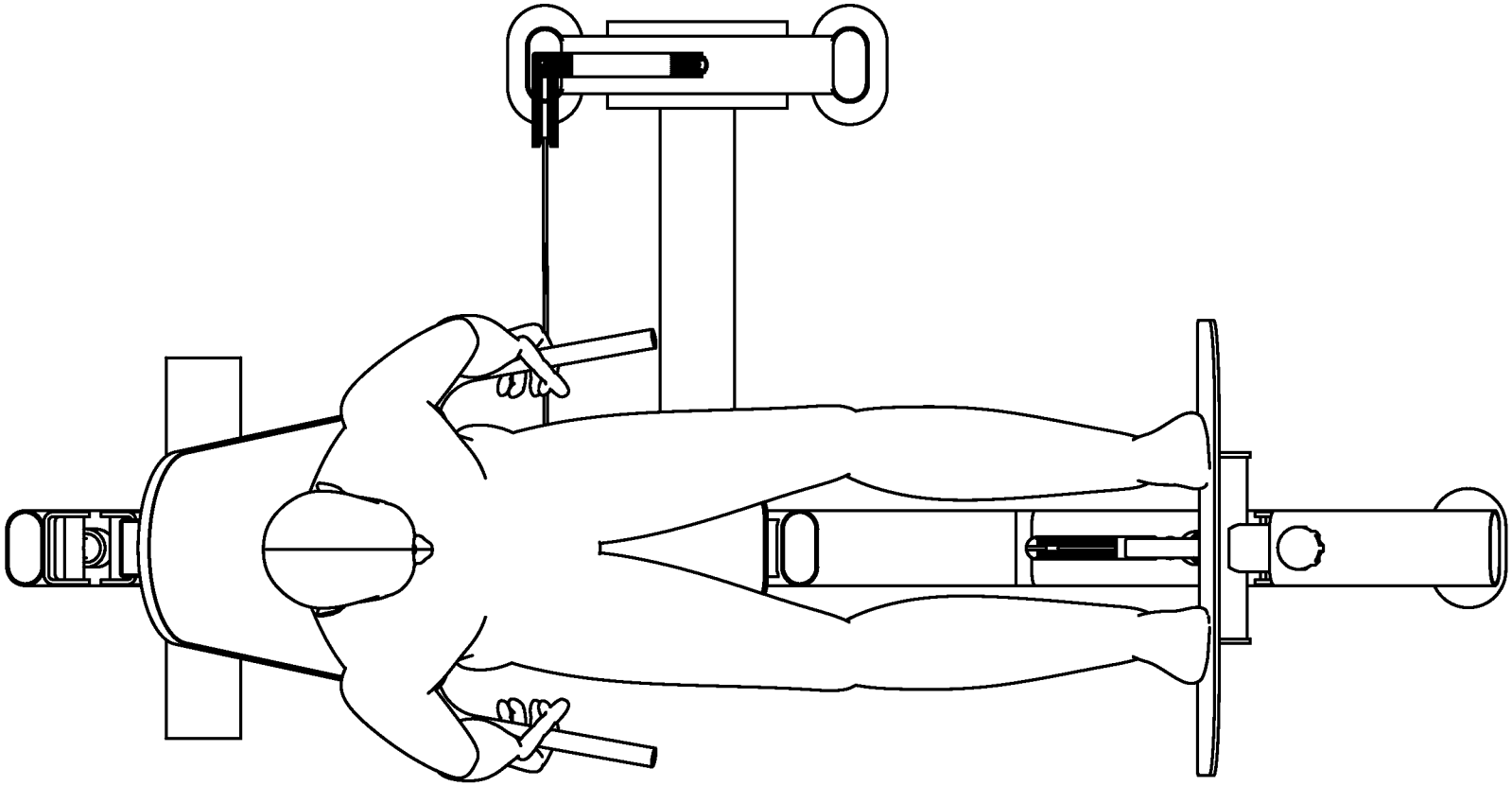
FIG. 23 illustrates a top view of the leg press machine in the end position during use.
Figure 24:
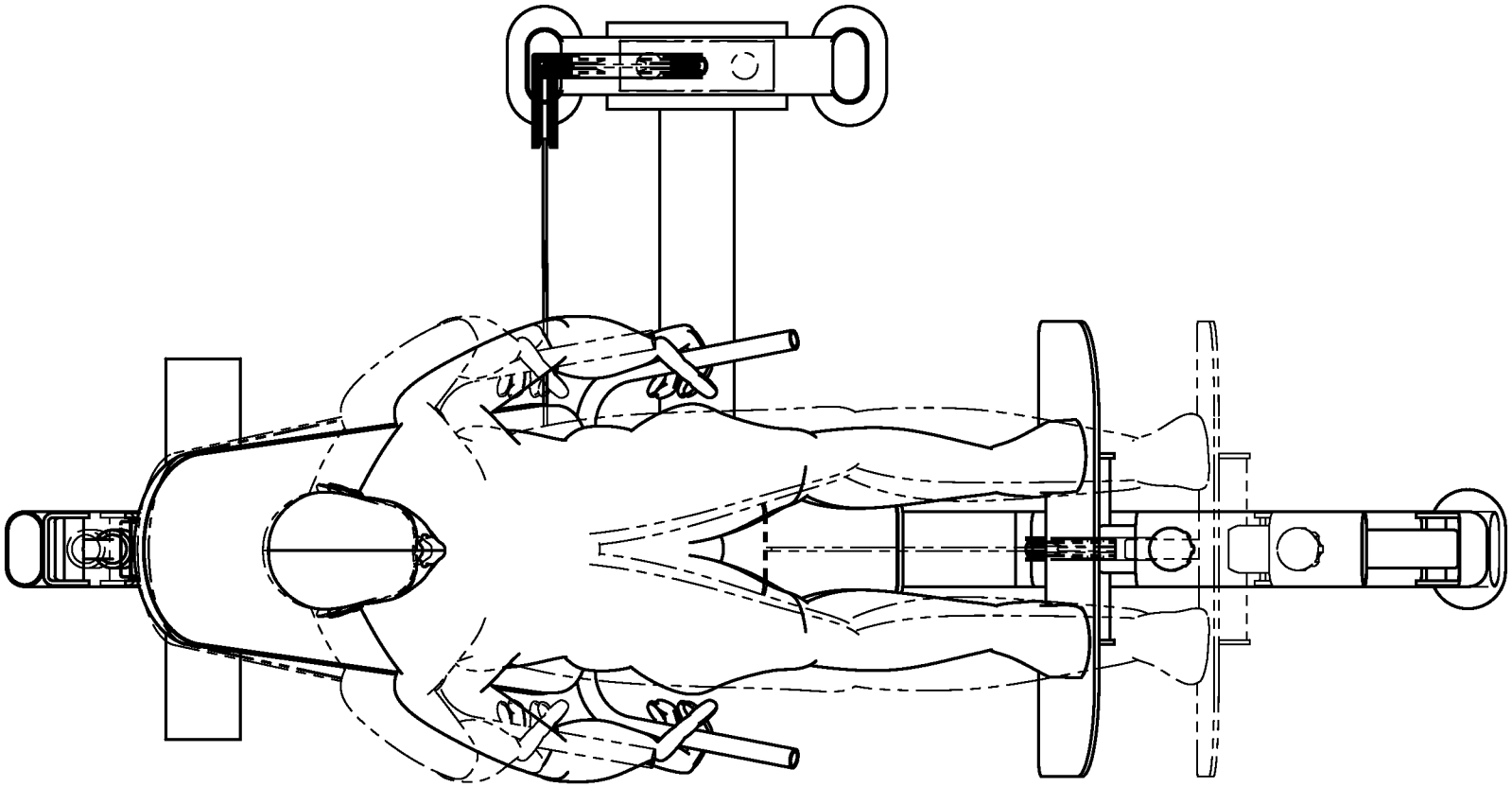
FIG. 24 illustrates a top view of the leg press machine showing the relative arrangements of the start position and end position during use.
Figure 25:
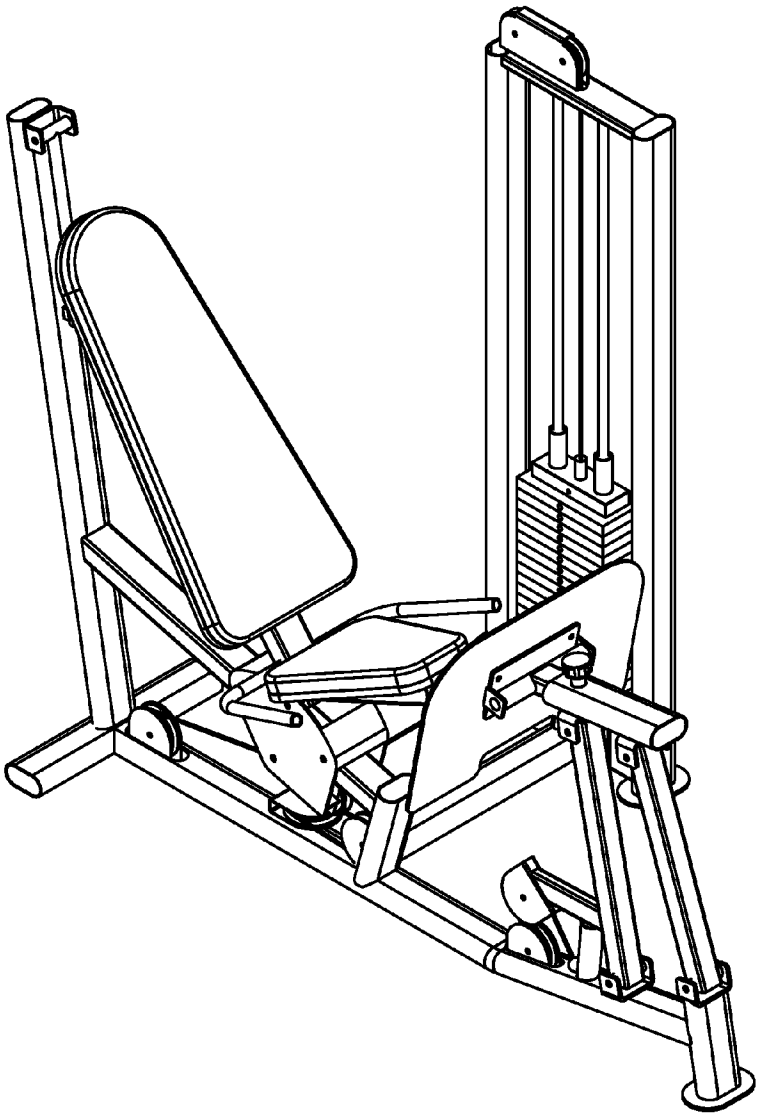
FIG. 25 illustrates a perspective view of the leg press machine in the start position.
Figure 26:
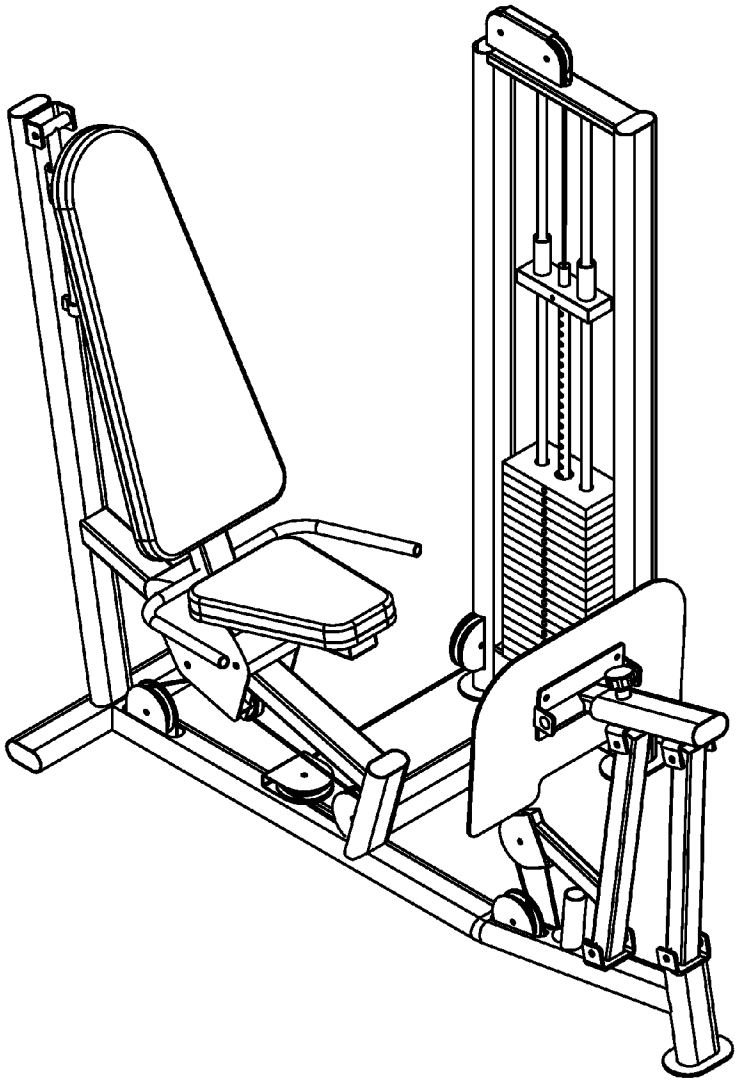
FIG. 26 illustrates a perspective view of the leg press machine in the end position.
Figure 27:
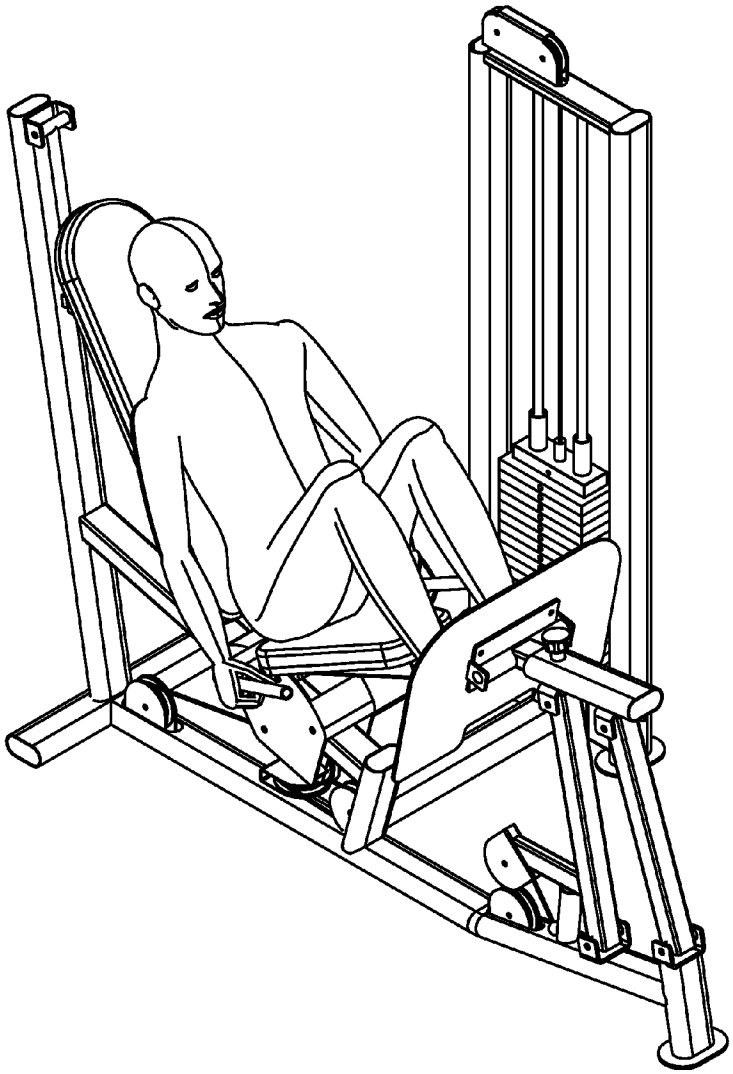
FIG. 27 illustrates a perspective view of the leg press machine in the start position during use.
Figure 28:
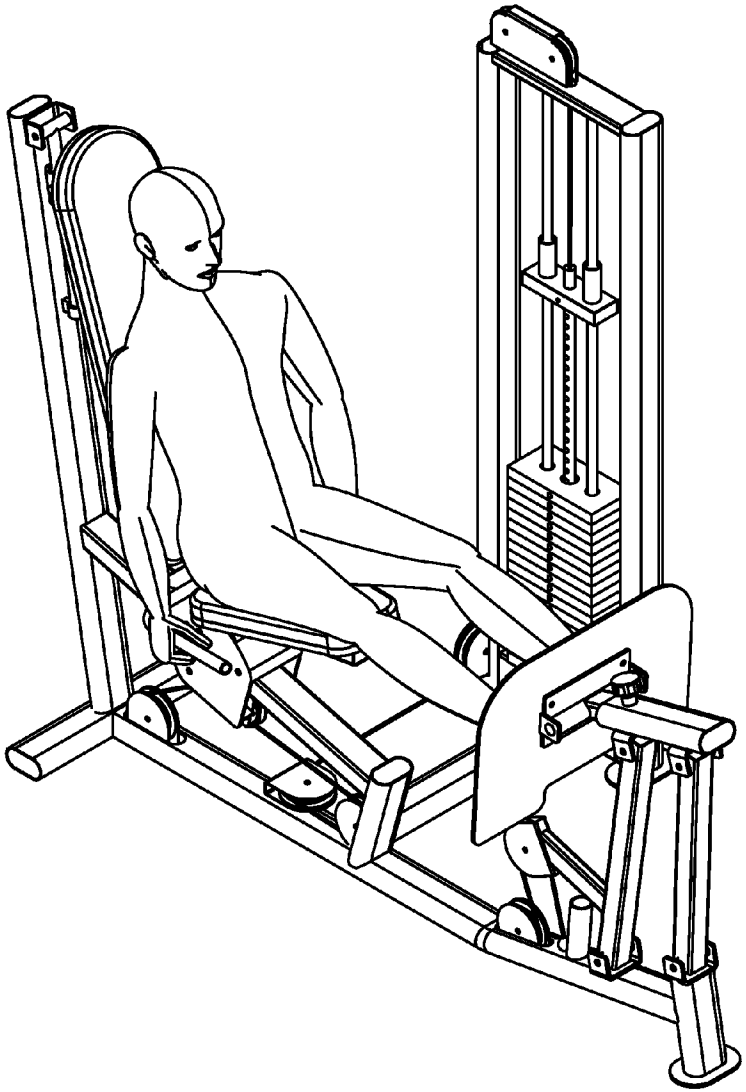
FIG. 28 illustrates a perspective view of the leg press machine in the end position during use.

FIGS. 16-18 illustrate side views of a leg press machine. FIGS. 19-24 illustrate side and top views of the leg press machine during use. FIGS. 25-26 illustrate perspective views of the leg press machine. FIGS. 27-28 illustrate perspective views of the leg press machine during use.

In this example, the cable resistance machine has the user in a seated position with legs extended straight out and placed on a foot plate. During the movement, the user pushes out on the plate, while in a simultaneous movement, both the upper and lower portions of the body extend away from each other in a natural forward and return arcing progression applying a continuous and equal amount of resistance. In addition, the user's quadriceps, hamstrings, lower back, calves and core stabilizing muscles may be engaged during the movement.

The rail in this example slopes upward as the movement progresses, while the column is aligned at an acute angle compared to the seat. In this example, the resistance element includes a flat footrest that is coupled to the cable system via a multi-point connection element as shown. In some embodiments, the footrest may be curved and/or otherwise modified from the example shown.

B. Seated Leg Curl

Figure 29:
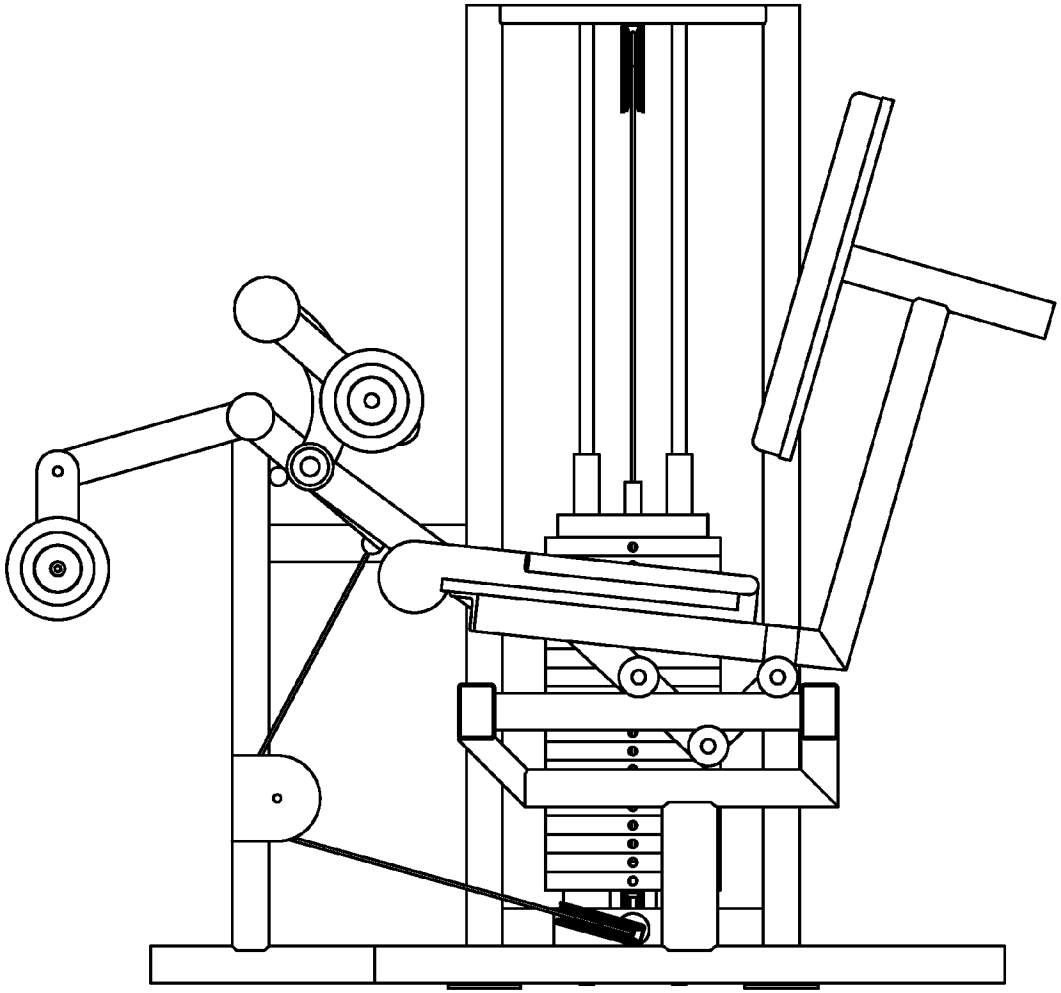
FIG. 29 illustrates a side view of a seated leg curl machine according to an exemplary embodiment of the invention in a start position.
Figure 30:
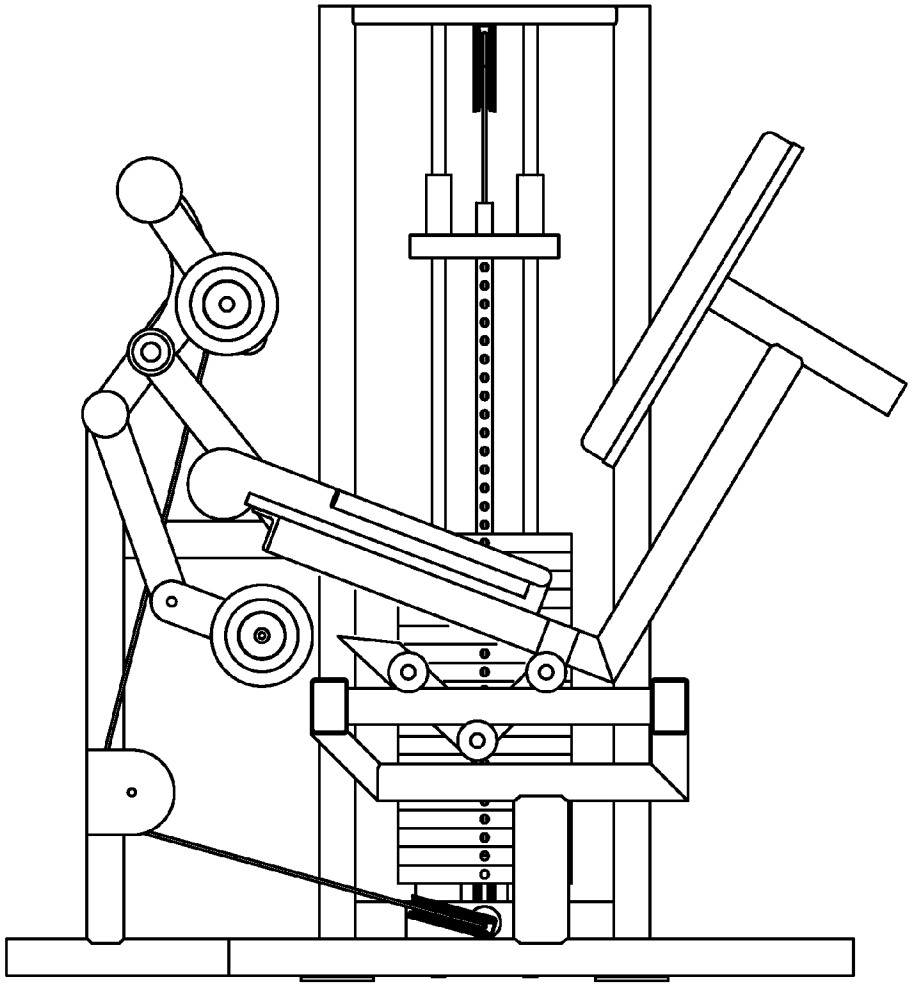
FIG. 30 illustrates a side view of the seated leg curl machine in an end position.
Figure 31:
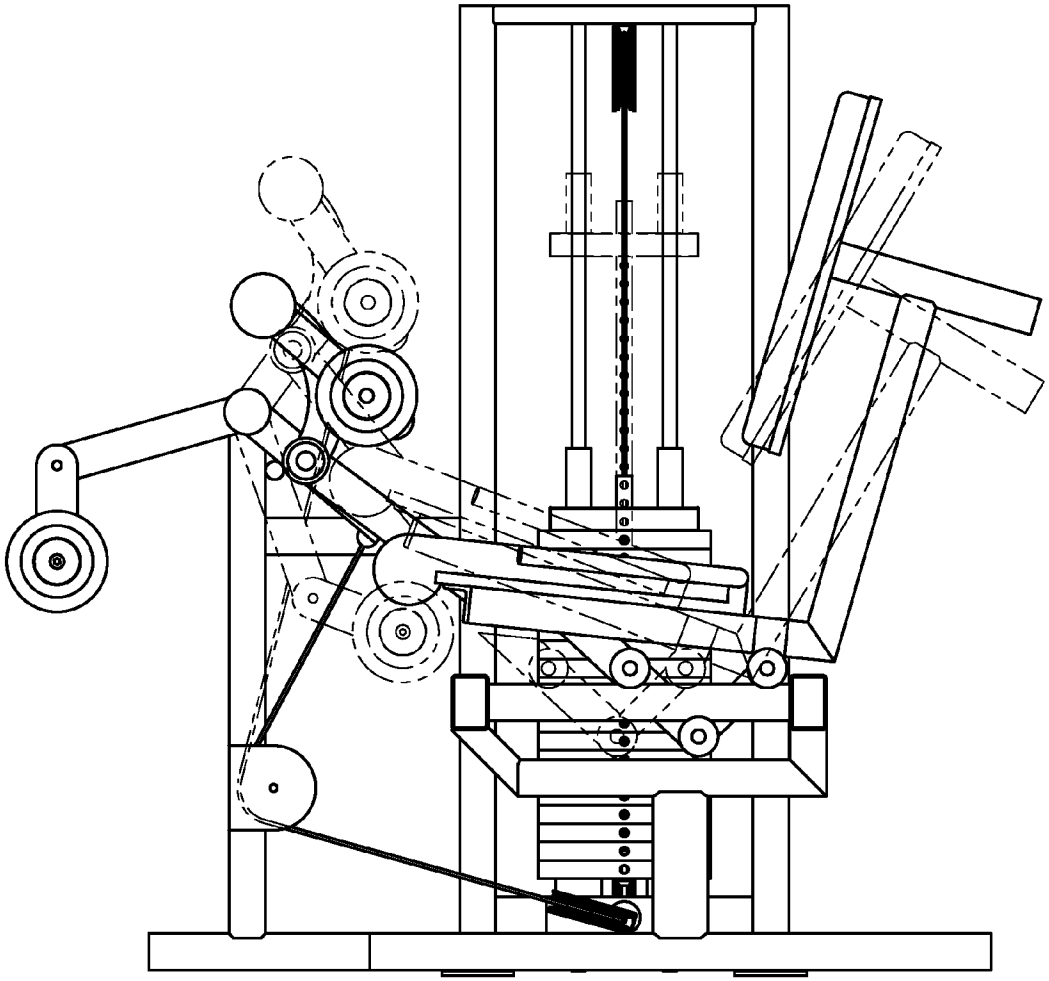
FIG. 31 illustrates a side view of the seated leg curl machine showing the relative arrangements of the start position and end position.
Figure 32:
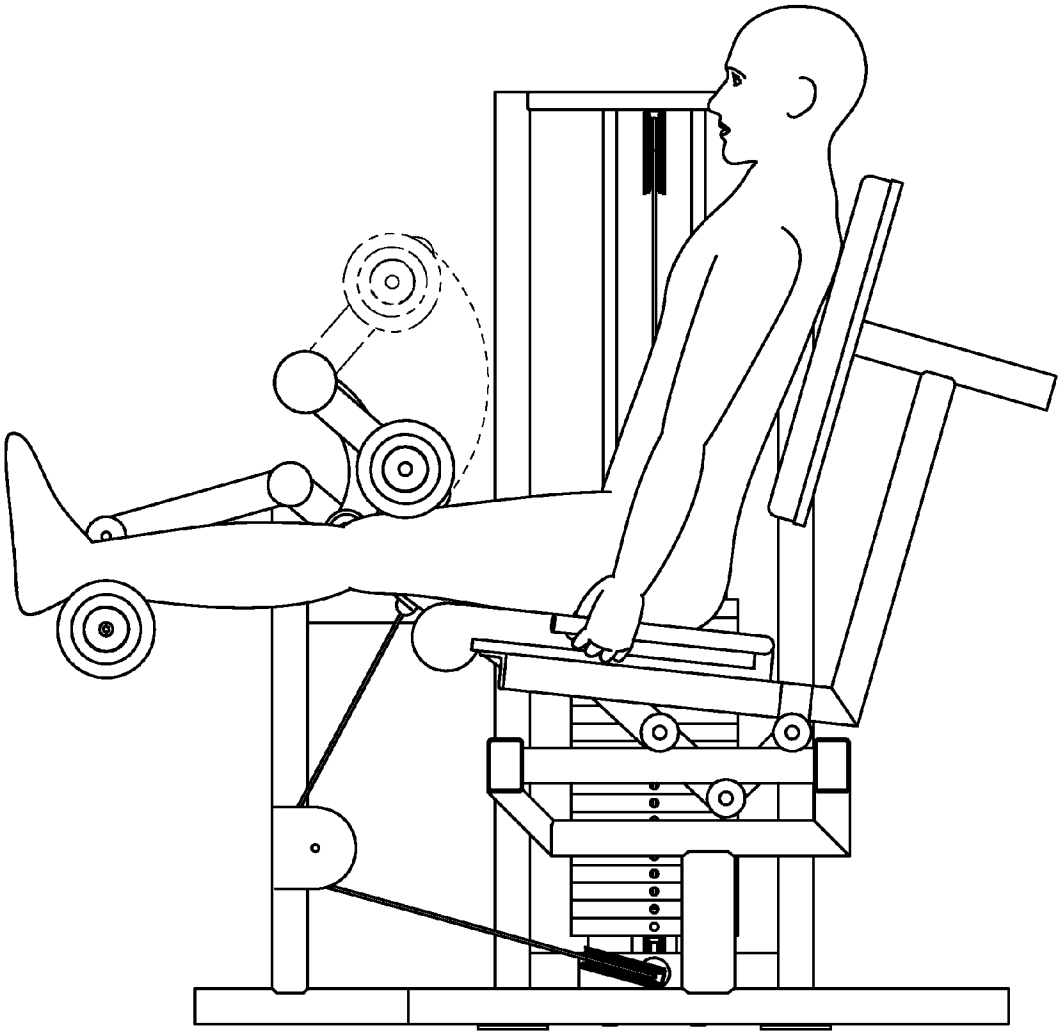
FIG. 32 illustrates a side view of the seated leg curl machine in the start position during use.
Figure 33:
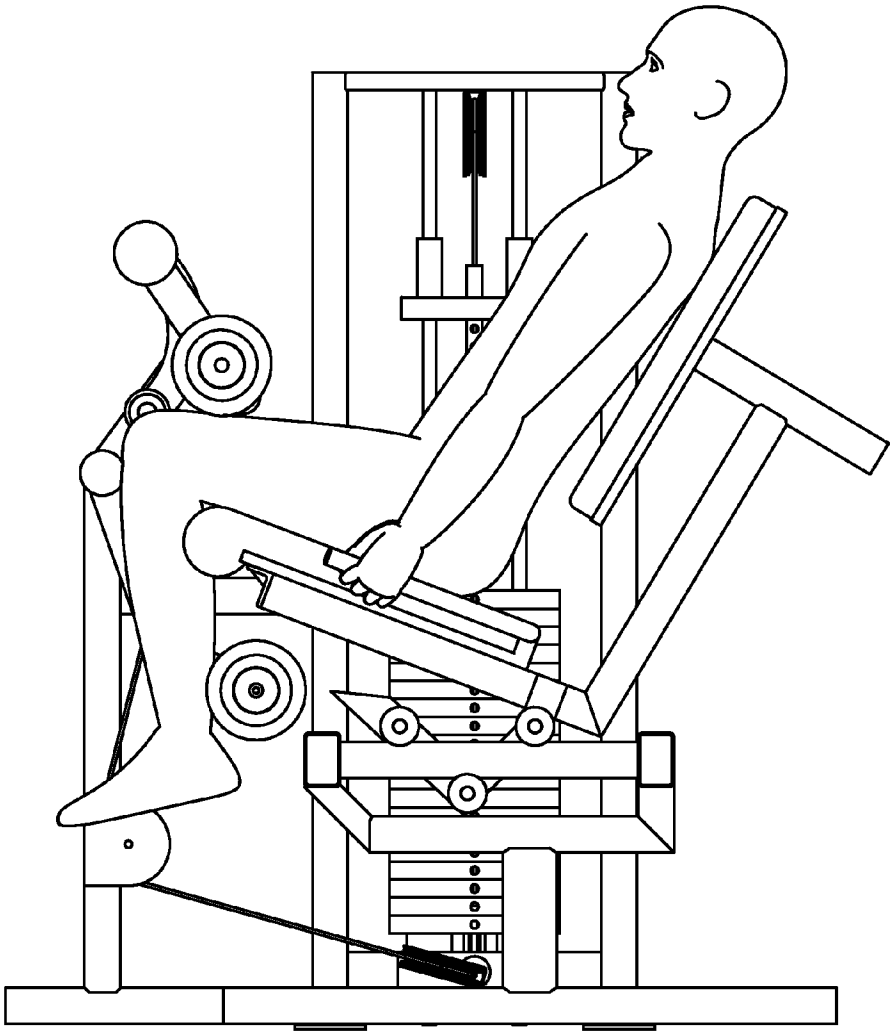
FIG. 33 illustrates a side view of the seated leg curl machine in the end position during use.
Figure 34:
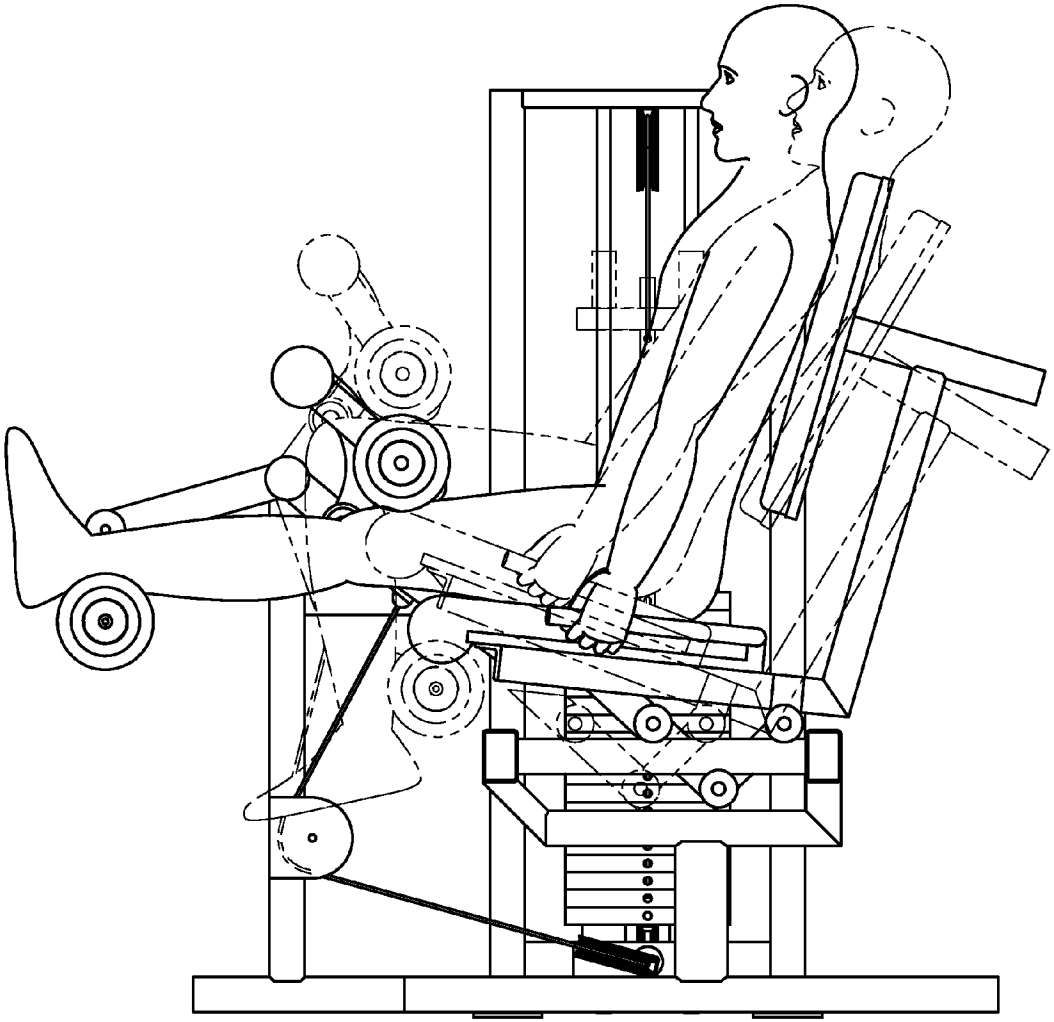
FIG. 34 illustrates a side view of the seated leg curl machine showing the relative arrangements of the start position and end position during use.
Figure 35:
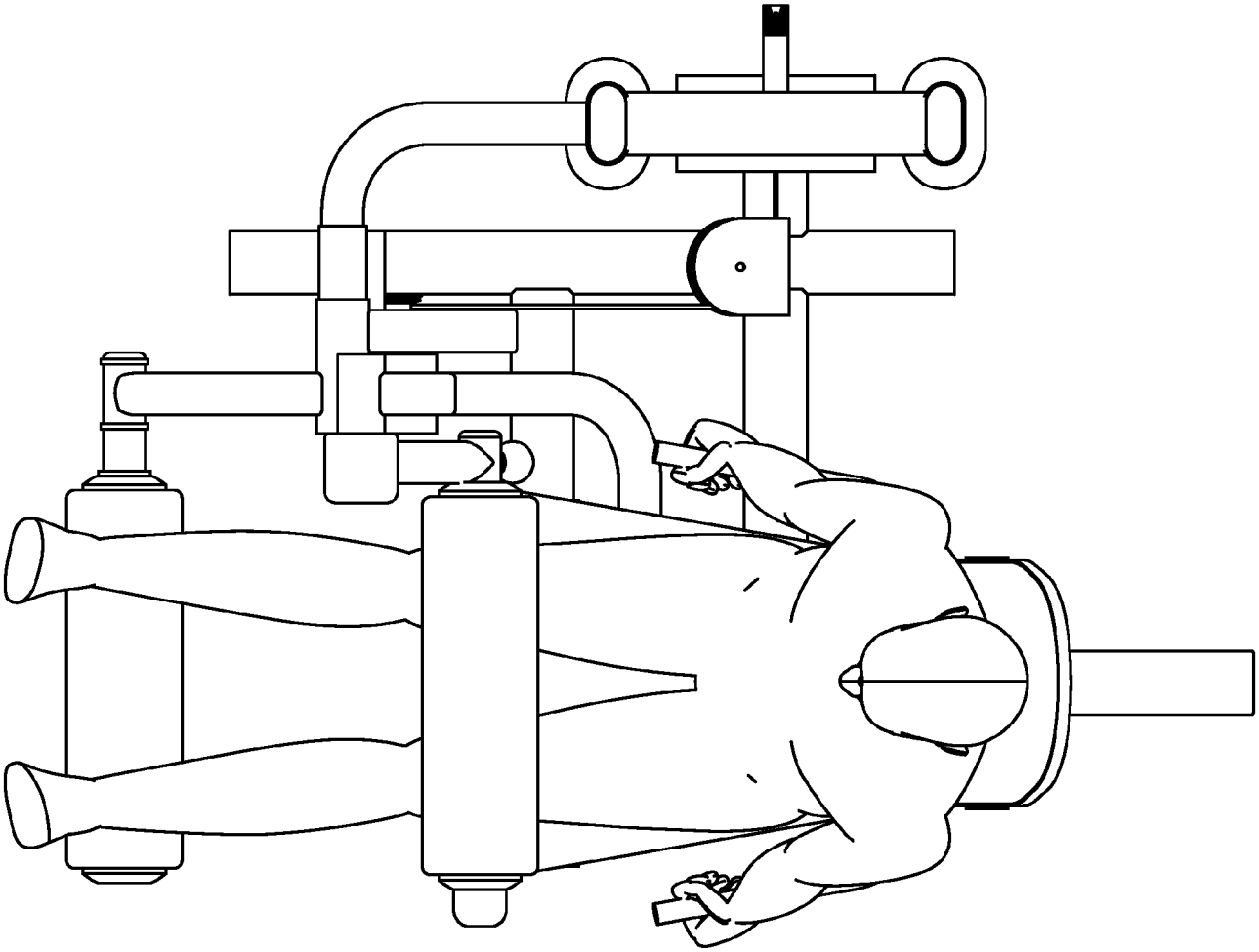
FIG. 35 illustrates a top view of the seated leg curl machine in the start position during use.
Figure 36:
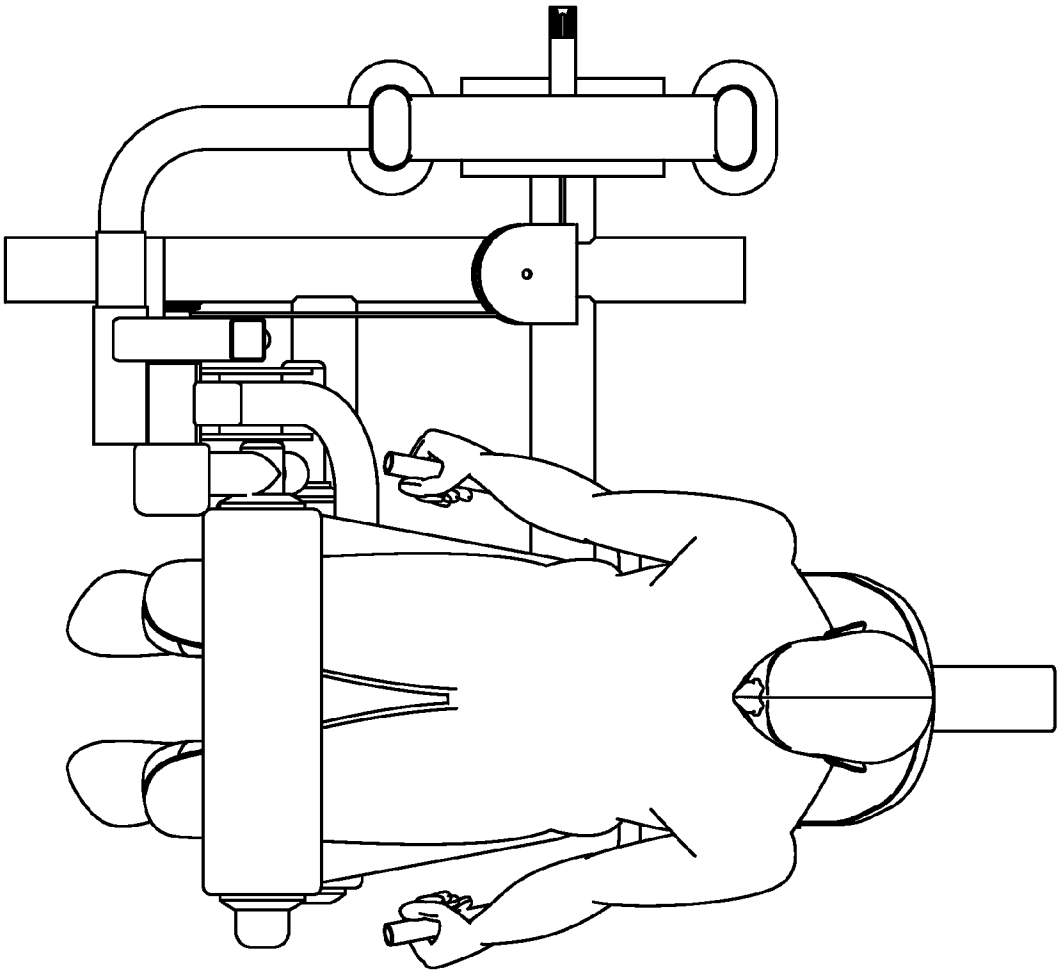
FIG. 36 illustrates a top view of the seated leg curl machine in the end position during use.
Figure 37:
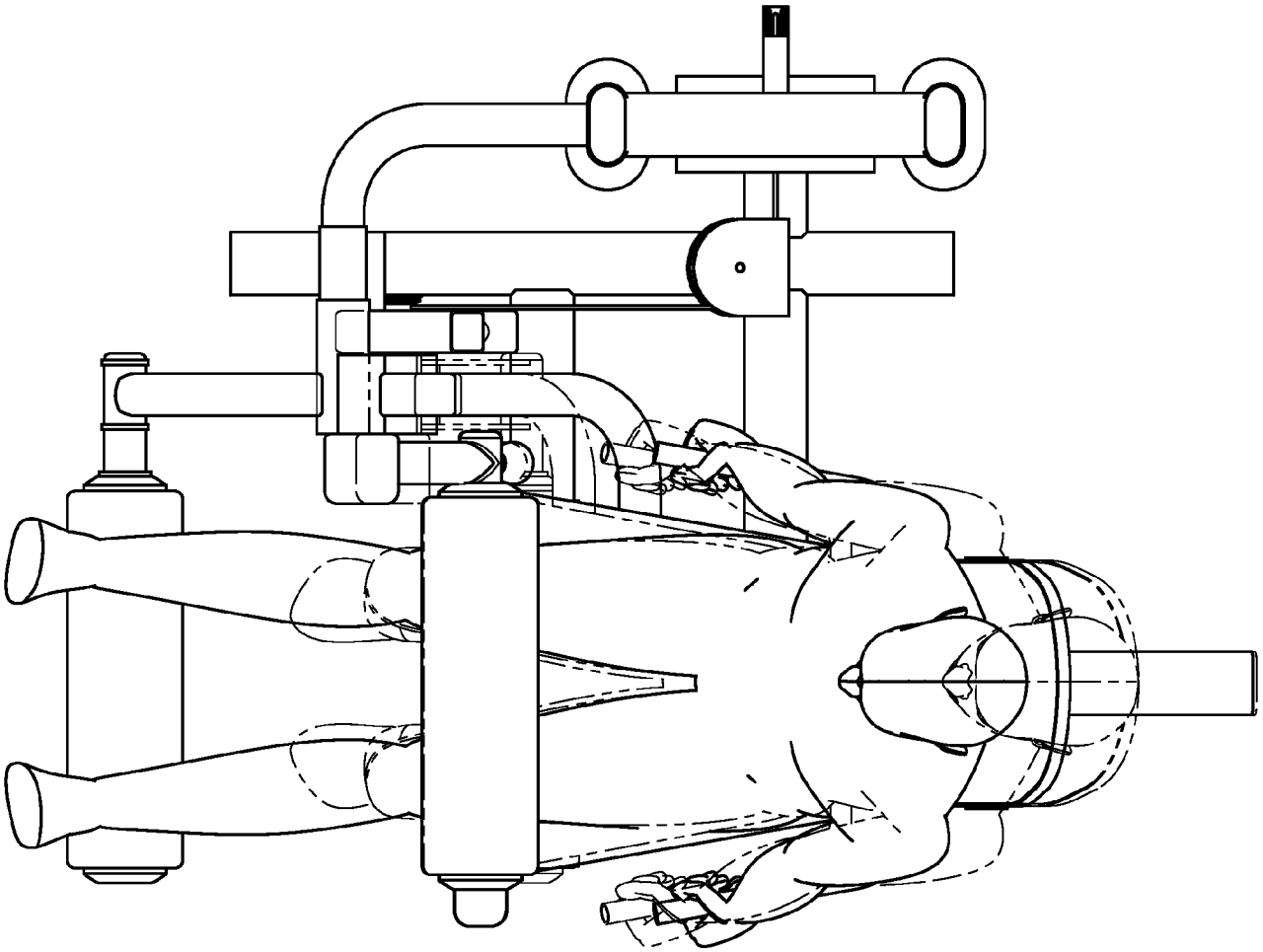
FIG. 37 illustrates a top view of the seated leg curl machine showing the relative arrangements of the start position and end position during use.
Figure 38:
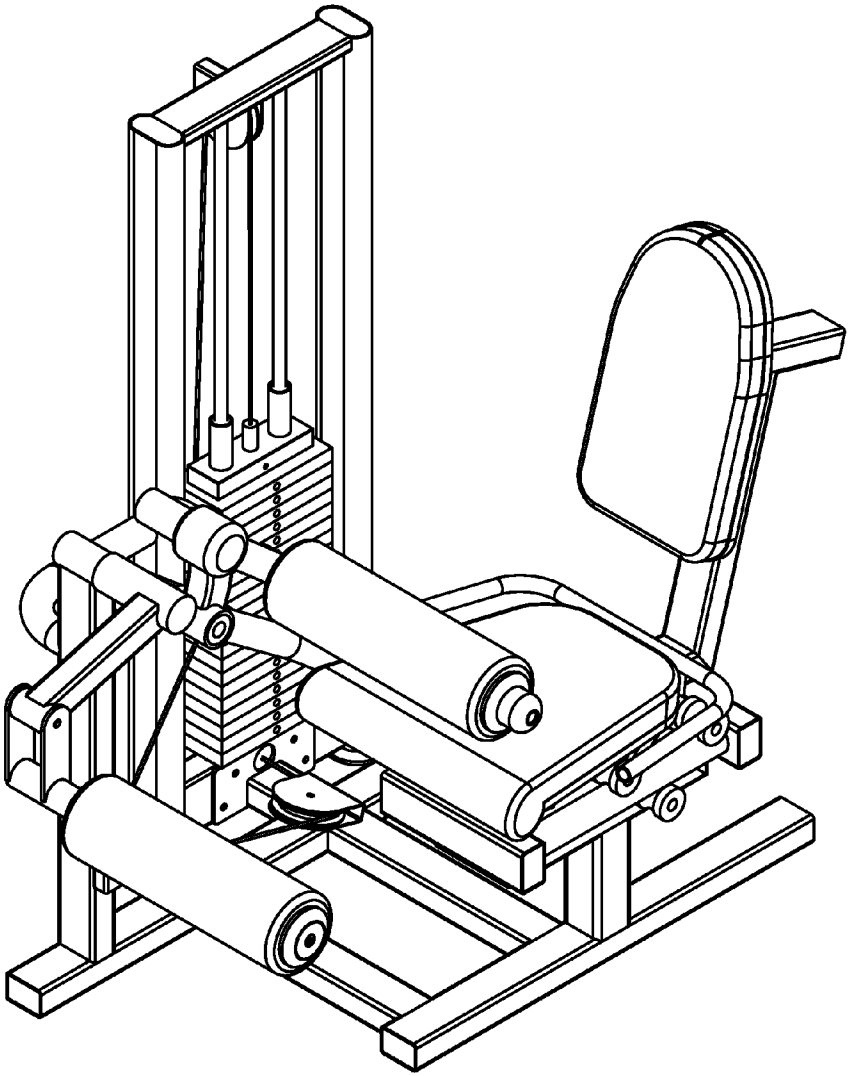
FIG. 38 illustrates a perspective view of the seated leg curl machine in the start position.
Figure 39:
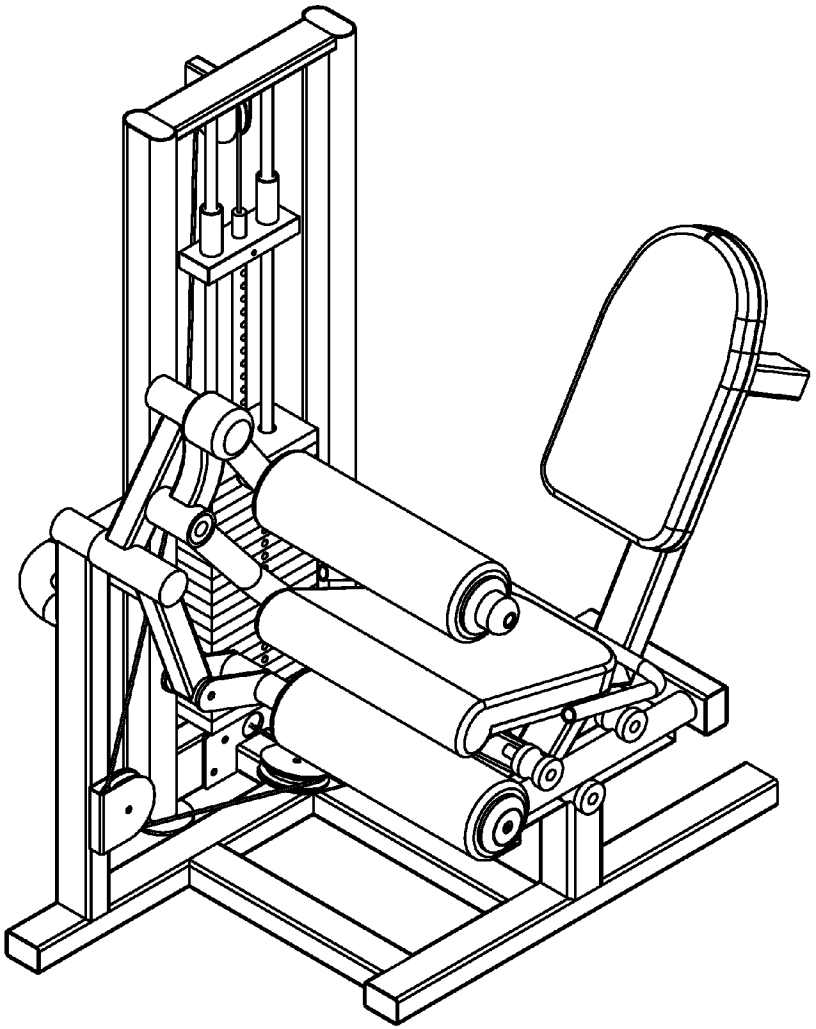
FIG. 39 illustrates a perspective view of the seated leg curl machine in the end position.
Figure 40:
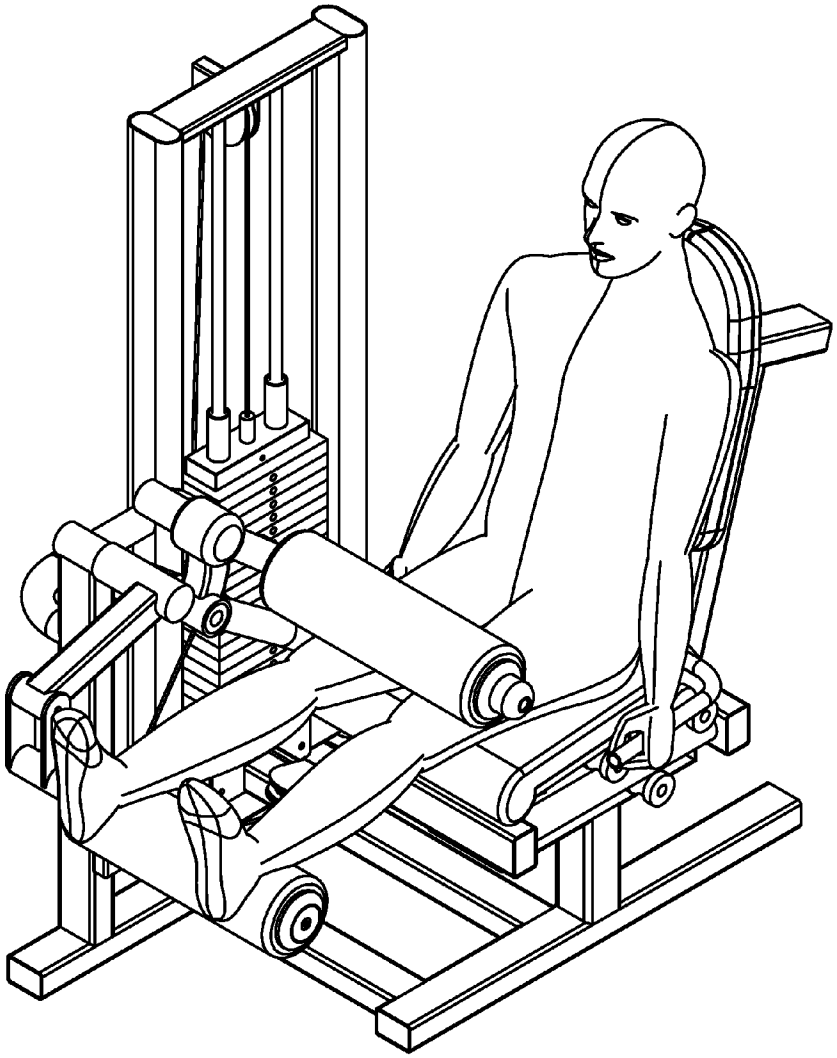
FIG. 40 illustrates a perspective view of the seated leg curl machine in the start position during use.
Figure 41:
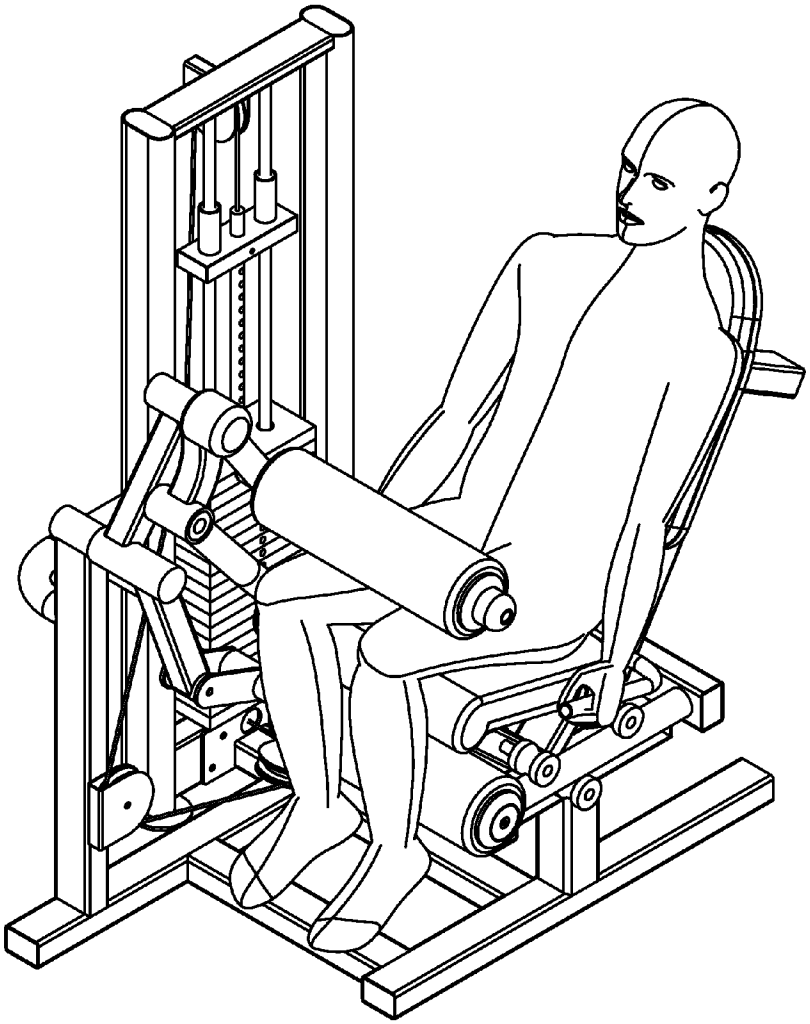
FIG. 41 illustrates a perspective view of the seated leg curl machine in the end position during use.

FIGS. 29-31 illustrate side views of a seated leg curl machine. FIGS. 32-37 illustrate side and top views of the seated leg curl machine during use. FIGS. 38-39 illustrate perspective views of the seated leg curl machine. FIGS. 40-41 illustrate perspective views of the seated leg curl machine during use.

In this example, the cable resistance machine places the user in a seated position with legs extended over the rotational padded arm directly in front, as the user pulls in a downward motion with one or both legs to rotate the padded arm back underneath their body. The user is rotated upward in a natural forward and return arcing progression applying a continuous and equal amount of resistance. In addition, the user's quadriceps, gluteus, knee joints, muscles and tendons, lower back, and core stabilizing muscles may be engaged during the movement.

The rail in this example is flat compared to the ground, while the second movement element includes multiple pivot points along the member and is integrated into the resistance path as shown. Thus, when a user performs the movement, body position is automatically adjusted by the position of the member as defined by the position of the user engagement element. Different embodiments may include different specific configurations. For instance, an alternative leg curl machine may have a slanted rail.

The machine of FIGS. 29-41 illustrates an example of improved functionality using the system of some embodiments. The tilting movement may help some users to perform a complete movement.

C. Leg Extension

Figure 42:
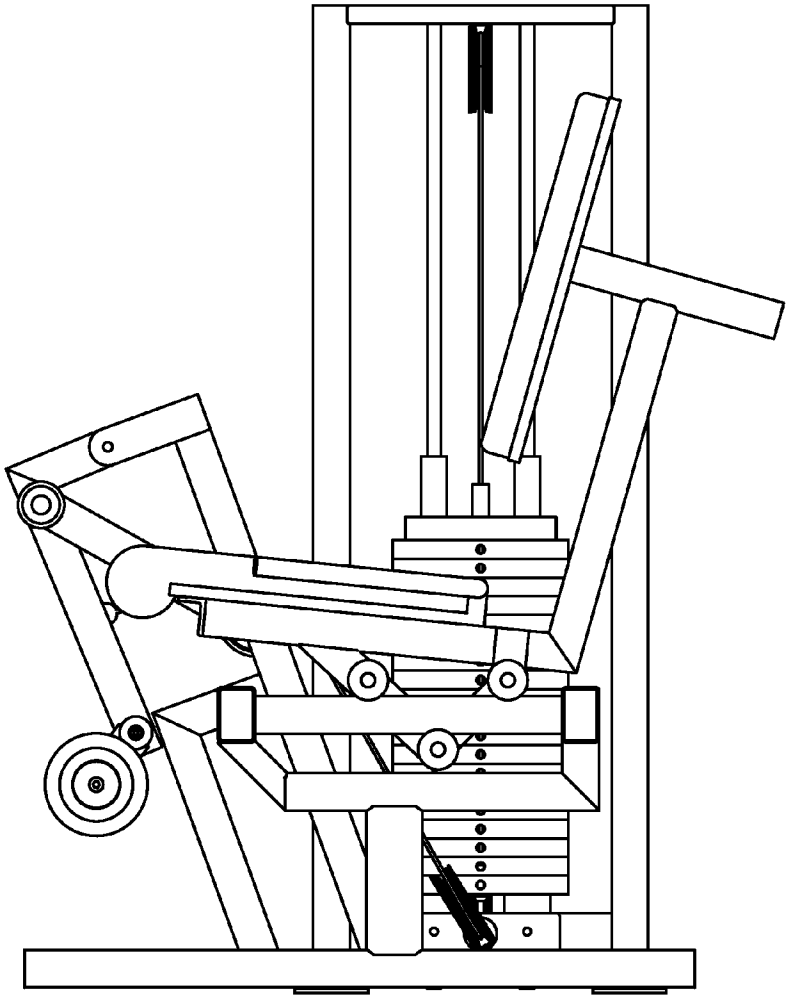
FIG. 42 illustrates a side view of a leg extension machine according to an exemplary embodiment of the invention in a start position.
Figure 43:
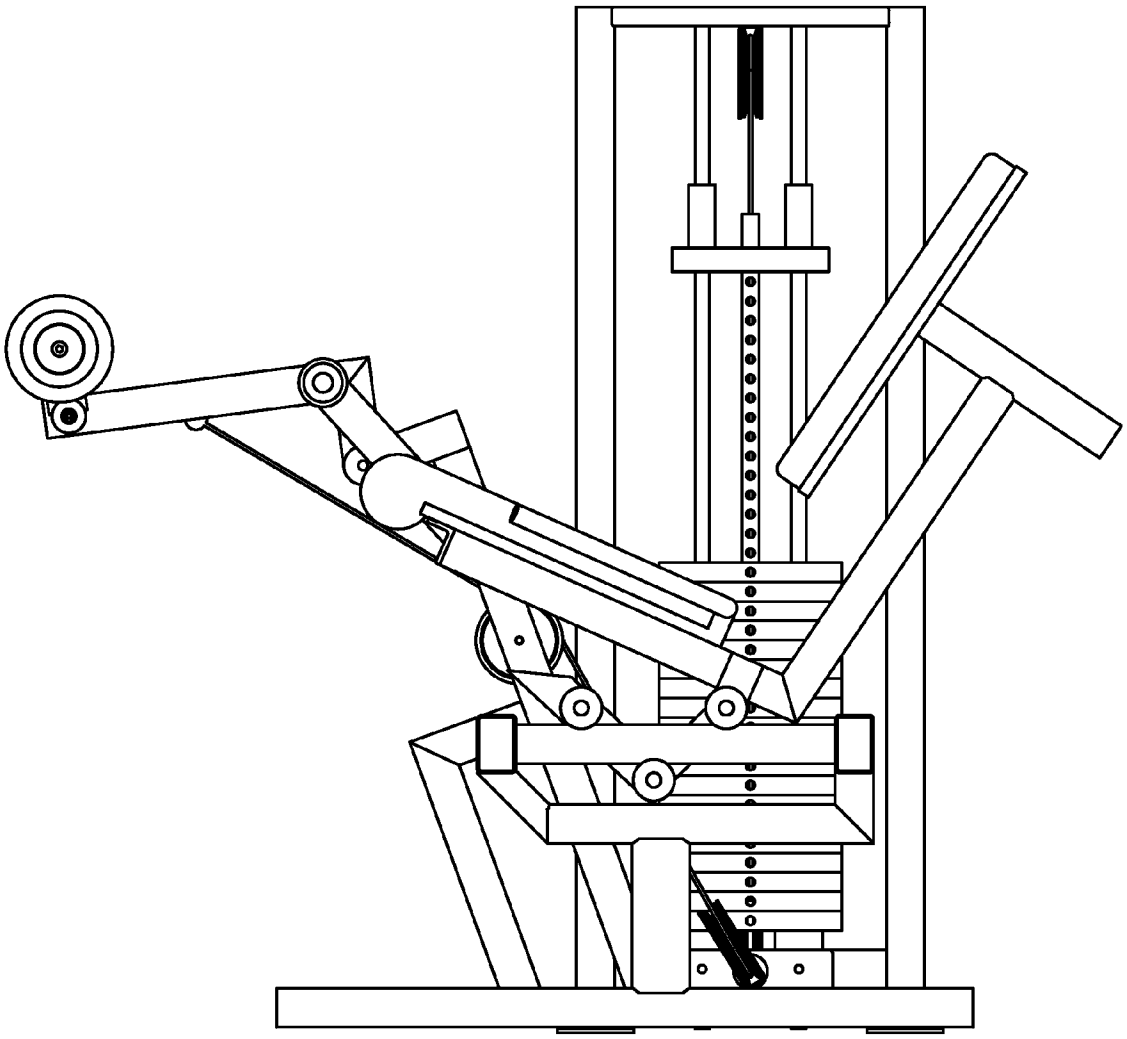
FIG. 43 illustrates a side view of the leg extension machine in an end position.
Figure 44:
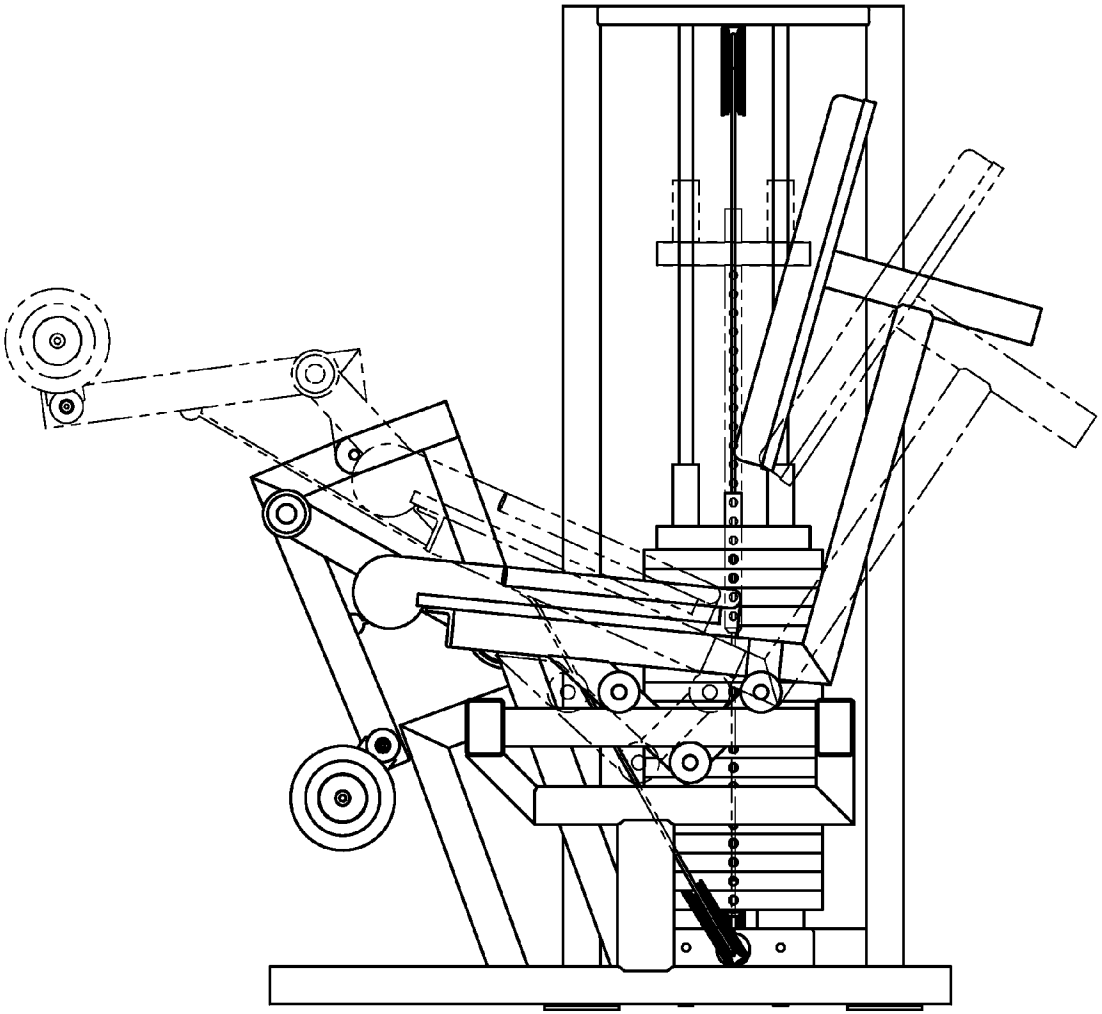
FIG. 44 illustrates a side view of the leg extension machine showing the relative arrangements of the start position and end position.
Figure 45:
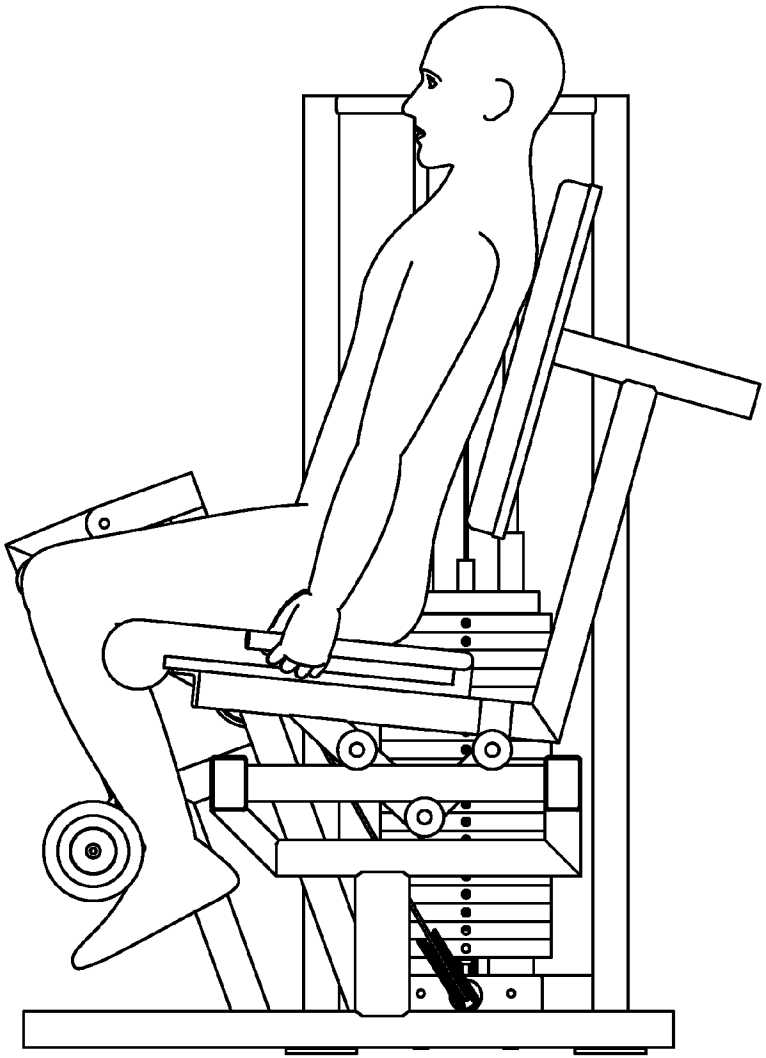
FIG. 45 illustrates a side view of the leg extension machine in the start position during use.
Figure 46:
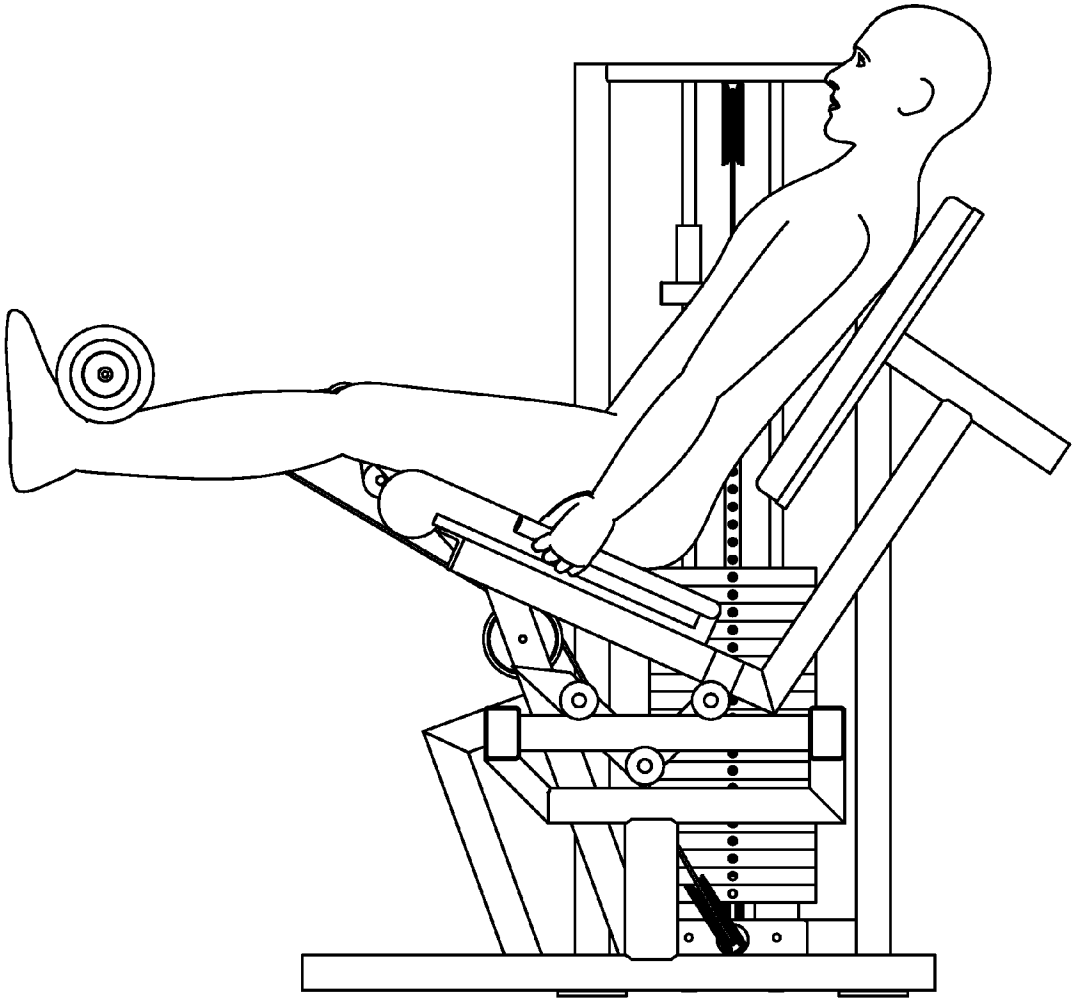
FIG. 46 illustrates a side view of the leg extension machine in the end position during use.
Figure 47:
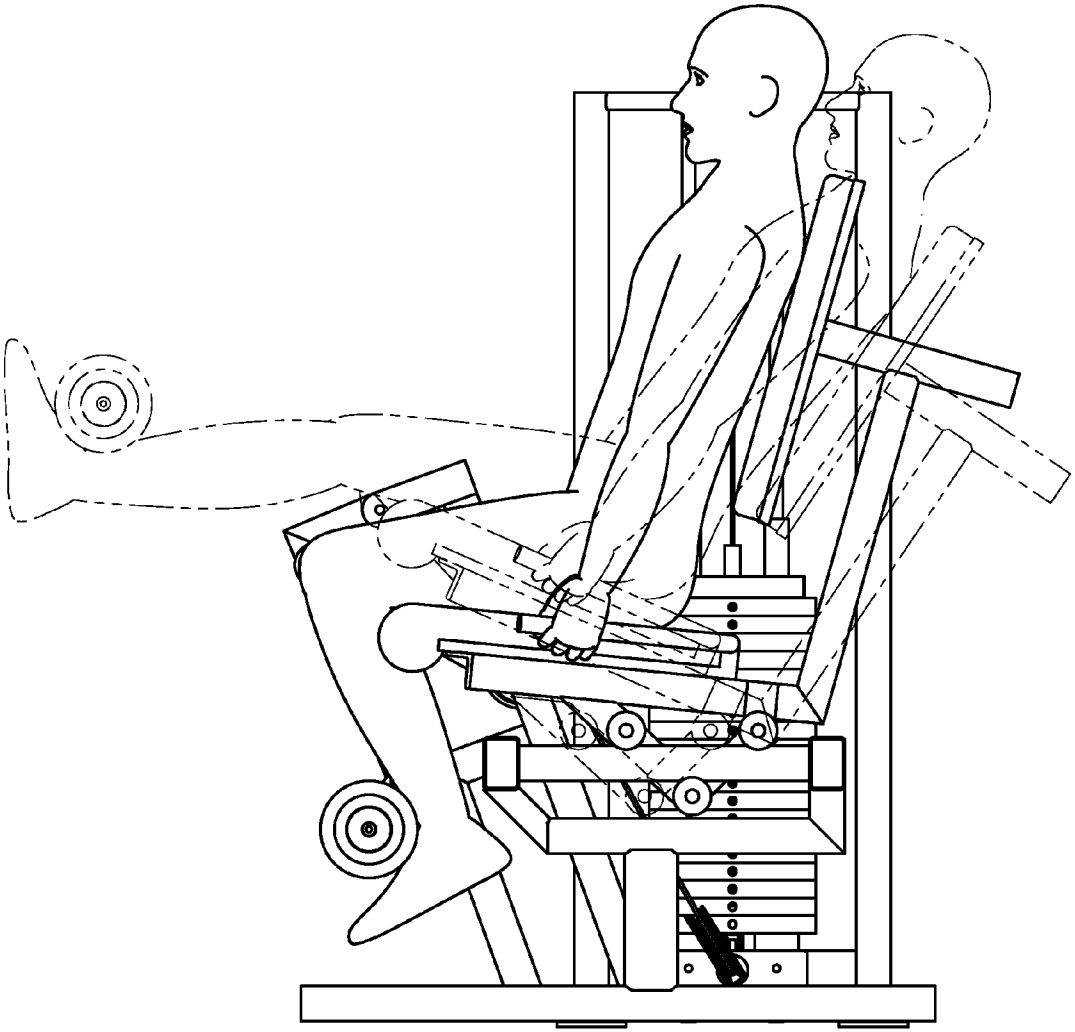
FIG. 47 illustrates a side view of the leg extension machine showing the relative arrangements of the start position and end position during use.
Figure 48:
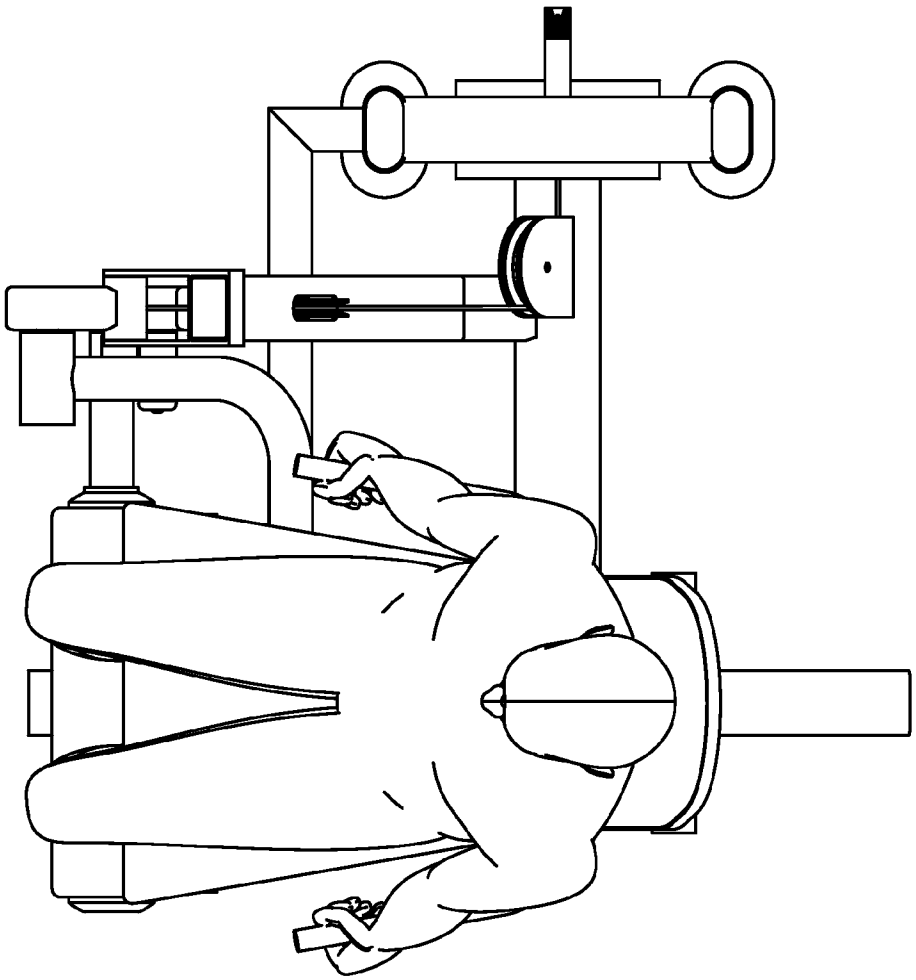
FIG. 48 illustrates a top view of the leg extension machine in the start position during use.
Figure 49:
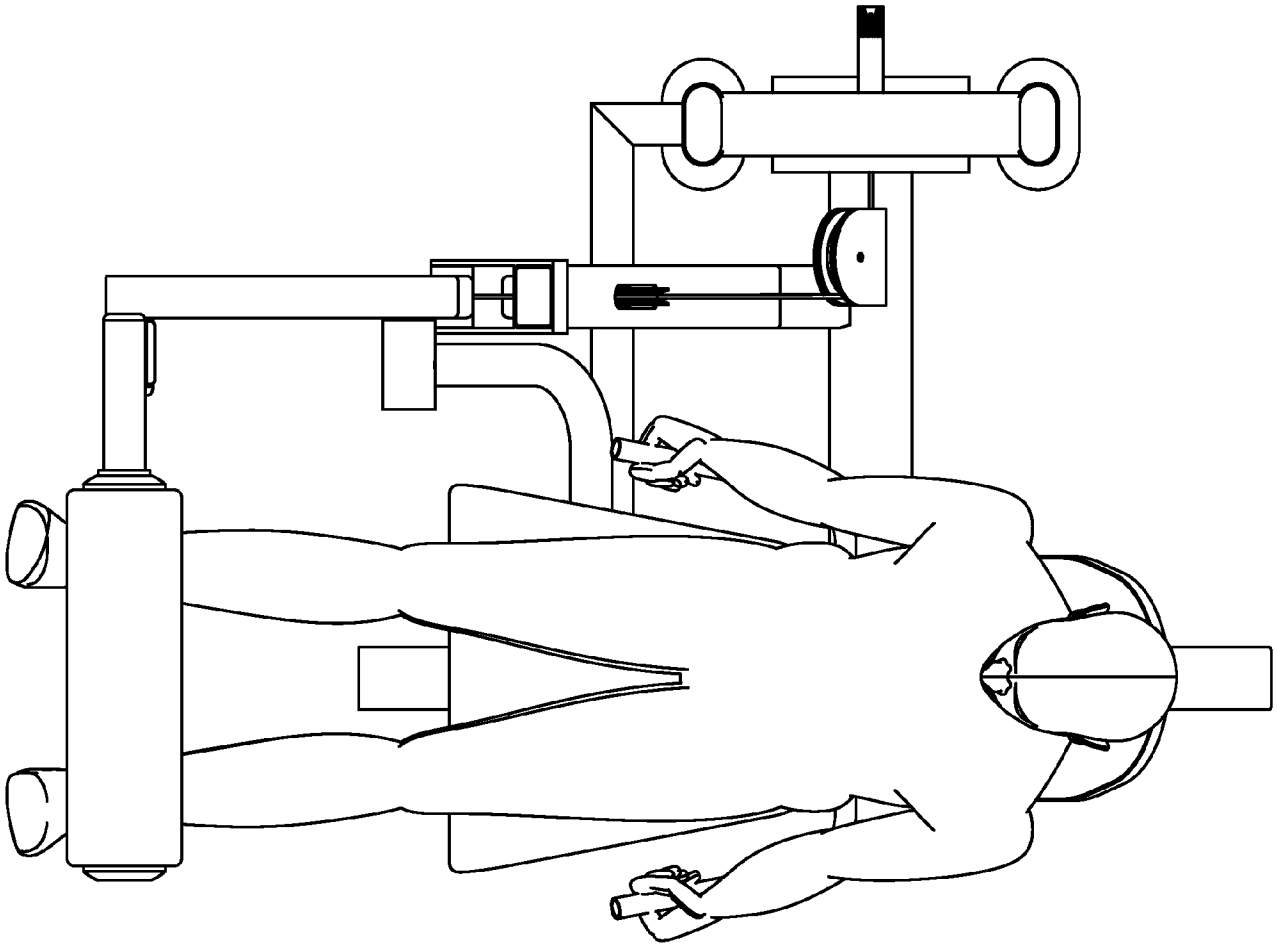
FIG. 49 illustrates a top view of the leg extension machine in the end position during use.
Figure 50:
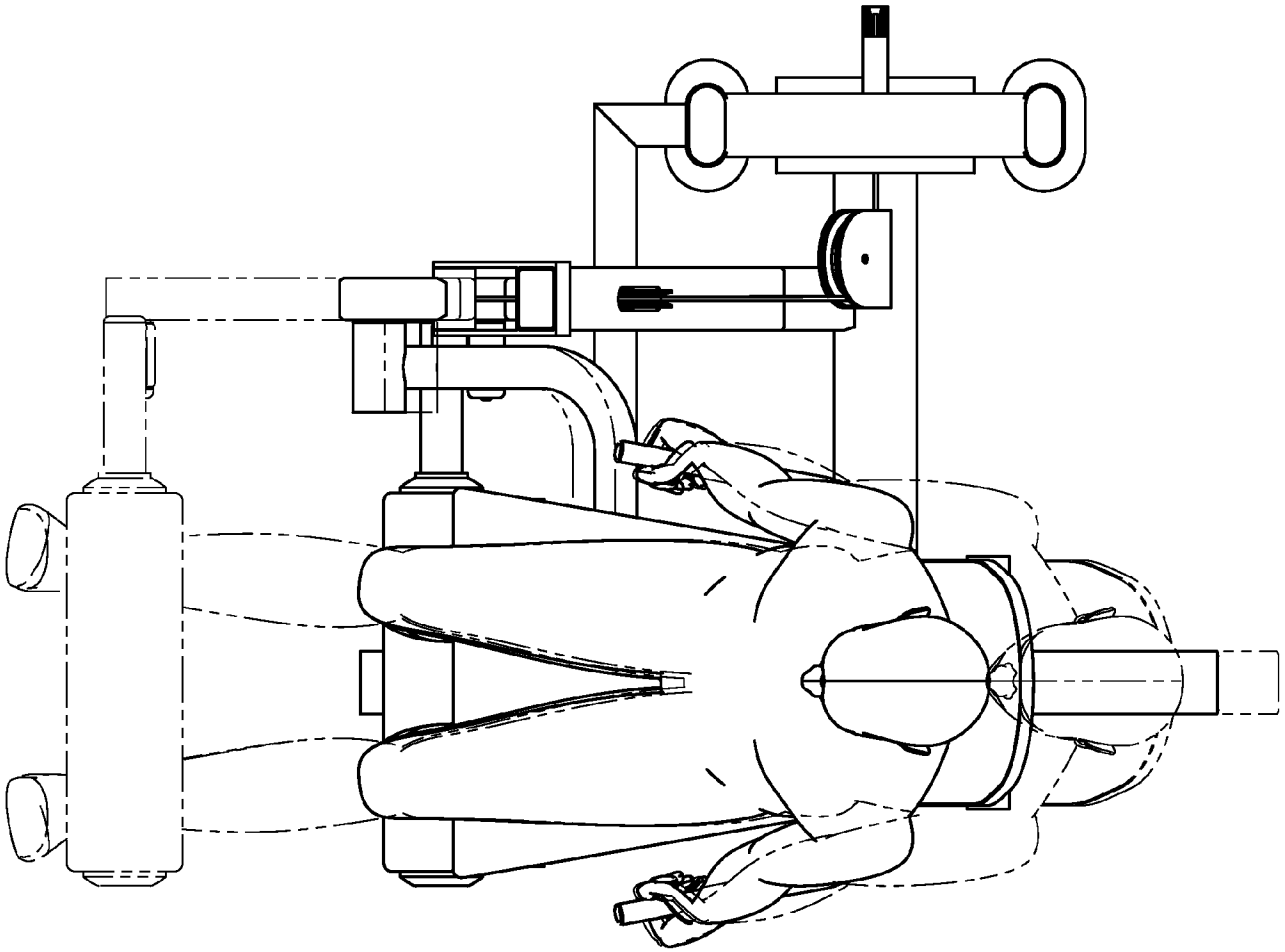
FIG. 50 illustrates a top view of the leg extension machine showing the relative arrangements of the start position and end position during use.
Figure 51:
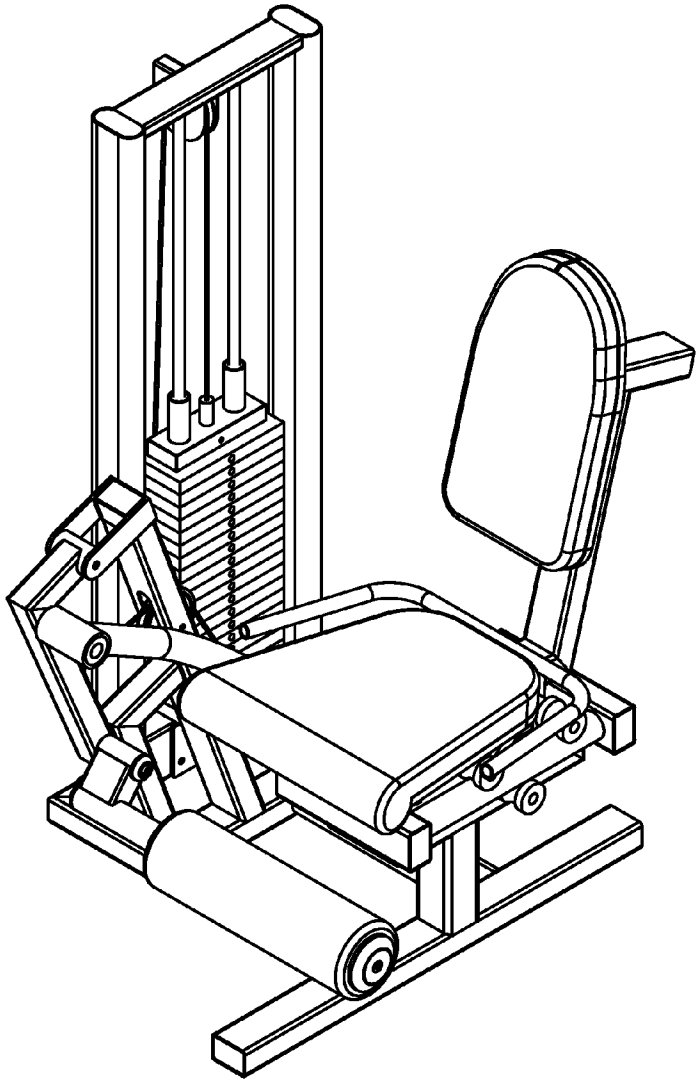
FIG. 51 illustrates a perspective view of the leg extension machine in the start position.
Figure 52:
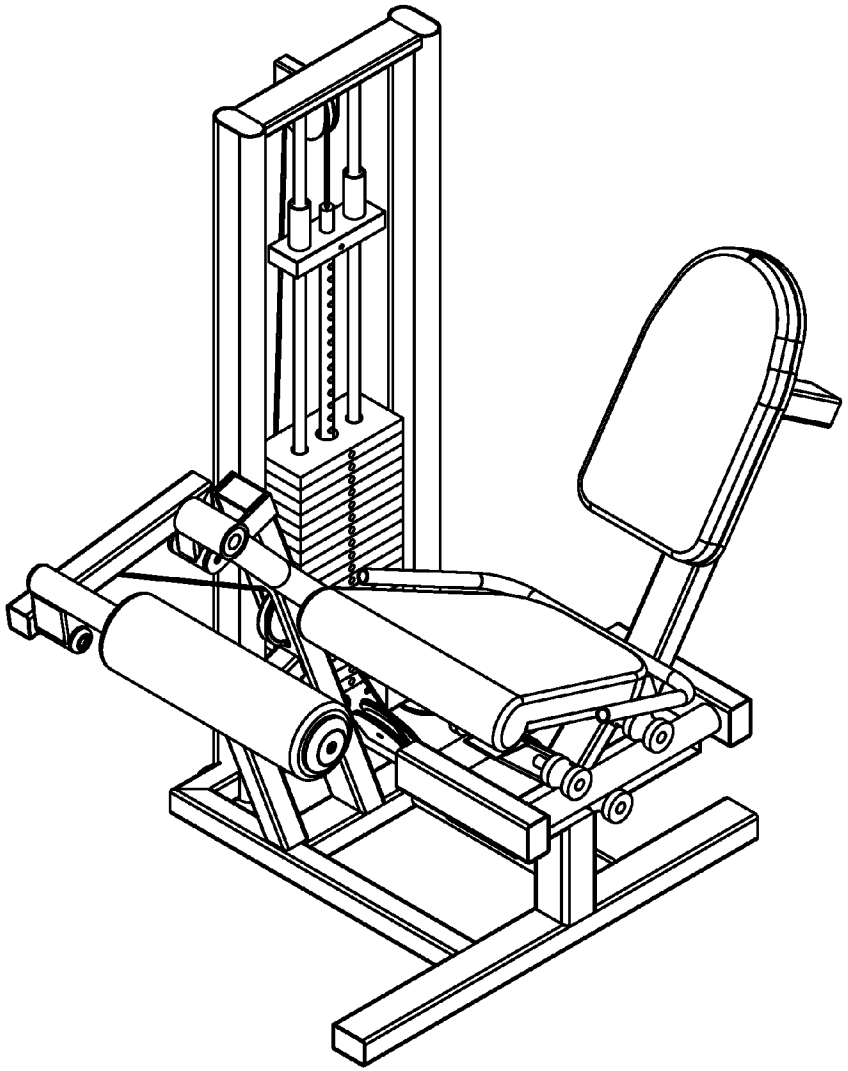
FIG. 52 illustrates a perspective view of the leg extension machine in the end position.
Figure 53:
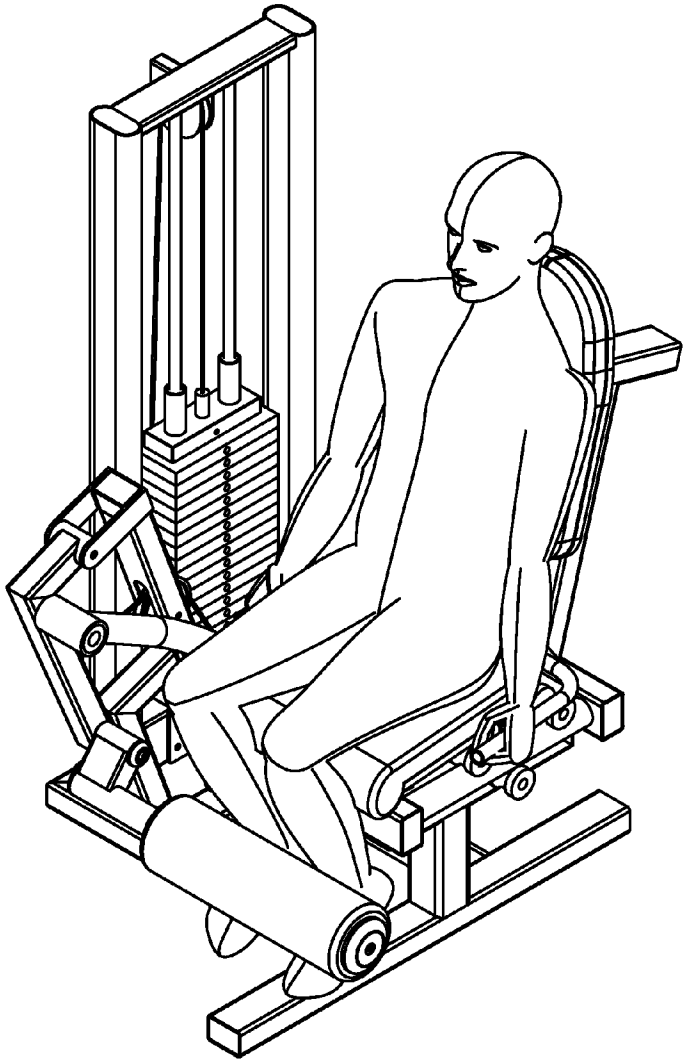
FIG. 53 illustrates a perspective view of the leg extension machine in the start position during use.
Figure 54:
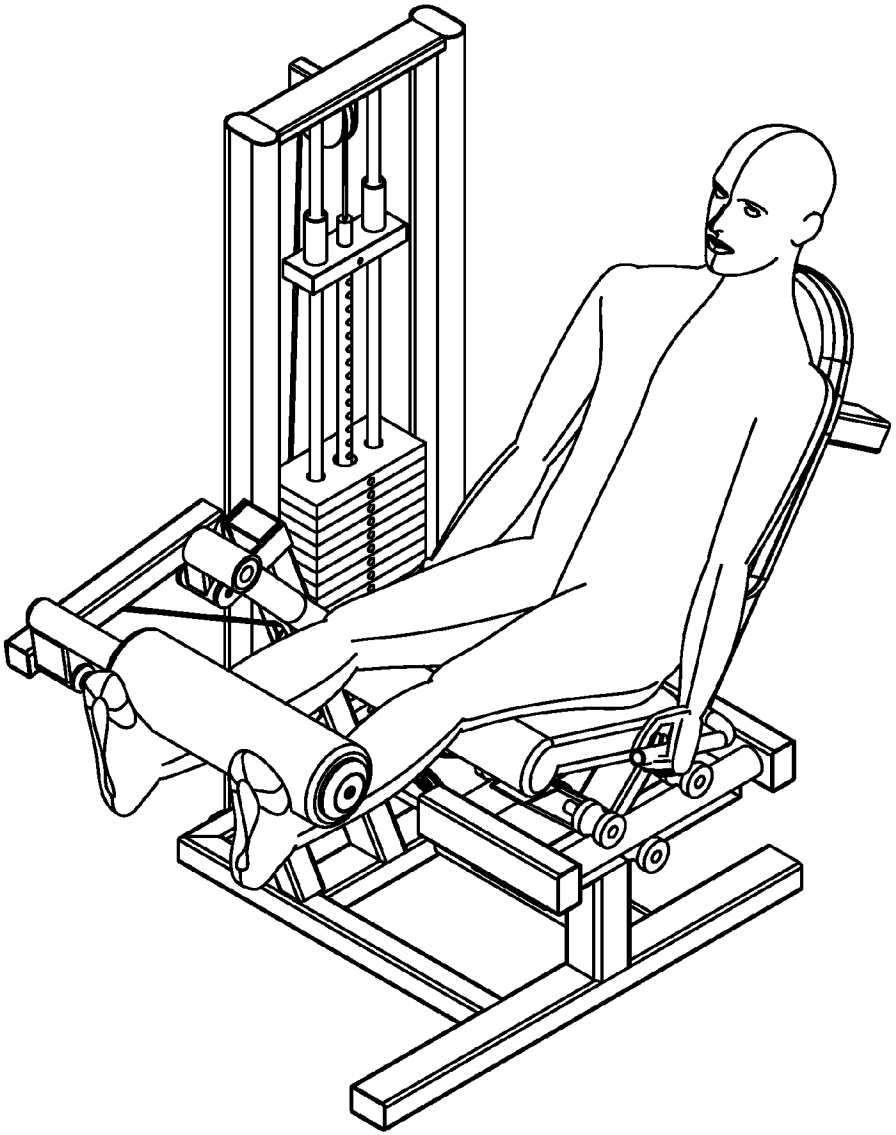
FIG. 54 illustrates a perspective view of the leg extension machine in the end position during use.

FIGS. 42-44 illustrate side views of a leg extension machine. FIGS. 45-50 illustrate side and top views of the leg extension machine during use. FIGS. 51-52 illustrate perspective views of the leg extension machine. FIGS. 53-54 illustrate perspective views of the leg extension machine during use.

In this example, the cable resistance machine places the user in a seated position with legs bent back underneath the seat and the padded rotational arm. During the movement, the user lifts in an upward motion with the leg or legs to rotate the padded arm forward and arcing up in front of the body. During the exercise, the user is rotated upward in a natural forward and return arcing progression applying a continuous and equal amount of resistance. In addition, the user's hamstrings, hip flexor, knee joints, muscles and tendons, lower back and core stabilizing muscles may be engaged during the movement.

The rail in this example is flat compared to the ground, while the second movement element includes multiple pivot points along the member and is integrated into the resistance path as shown. Thus, when a user performs the movement, body position is automatically adjusted by the position of the member as defined by the position of the user engagement element. Different embodiments may include different specific configurations. For instance, an alternative leg extension machine may include a sloped rail.

The machine of FIGS. 42-54 illustrates an example of improved functionality using the system of some embodiments. Users may find it easier to get full extension when tilting back as the exercise progresses.

D. Alternative Implementations

One of ordinary skill in the art will realize that the machines described in sub-sections II.A-II.C are presented for exemplary purposes and different embodiments may be implemented in various different ways.

For instance, some embodiments may provide machines that target different muscle groups than those described above (e.g., a gluteus machine). As another example, different embodiments may include different cable and/or handle configurations than those shown (e.g., instead of using independent handles, some embodiments may use a bar). In addition, various embodiments may be configured in various different ways (e.g., with different slopes, different connecting element, different resistance elements, etc.). In some embodiments, various features may be configured in various different ways by the user (e.g., using different connection points, by adjusting the length of an element, by replacing one or more elements, etc.).

The foregoing relates to illustrative details of exemplary embodiments of the invention and modifications may be made without departing from the spirit and scope of the invention as defined by the following claims.

We claim:

1. A leg press machine adapted to perform functional training, the leg press machine comprising:

a cable resistance element adapted to allow for a resistance path that is at least partly defined by a user;

a user support adapted to move along a movement path as a leg press is performed;

a load including a set of plates that may be selectively coupled to the cable resistance element;

a rail;

a carriage movably coupled to the rail, wherein the movement path is at least partly defined by movement of the carriage along the rail, and the user support is movably coupled to the carriage at a first pivot axis;

a column; and a connecting element movably coupled to the column, wherein the movement path is at least partly defined by movement of the connecting element along the column, and the user support is movably coupled to the connecting element.

2. The leg press machine of claim 1, wherein the connecting element includes a second pivot axis.

3. The leg press machine of claim 1 further comprising a user engagement element coupled to the cable resistance element, wherein the user engagement element has at least two pivot axes.

4. The leg press machine of claim 3, wherein the user support moves along the movement path in a first direction when external force is applied to the user engagement element and in a second direction when external force is released from the user engagement element.

* * * * *